US012317948B2

(12) United States Patent
Bryan et al.

(10) Patent No.: US 12,317,948 B2
(45) **Date of Patent: *Jun. 3, 2025**

(54) BRIM FOR ATTACHING TO HEADGEAR

(71) Applicant: Bryan Family Enterprises LLC, Union City, CA (US)

(72) Inventors: Teresa A. Bryan, Union City, CA (US); John E. Bryan, Union City, CA (US)

(73) Assignee: Bryan Family Enterprises LLC, Union City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/390,771

(22) Filed: Dec. 20, 2023

(65) Prior Publication Data

US 2024/0122286 A1 Apr. 18, 2024

Related U.S. Application Data

(63) Continuation of application No. 17/844,016, filed on Jun. 19, 2022, now Pat. No. 11,882,895, which is a (Continued)

(51) Int. Cl.
*A42B 3/22* (2006.01)
*A42B 3/04* (2006.01)

(52) U.S. Cl.
CPC ..... *A42B 3/227* (2013.01); *A42B 3/0406* (2013.01)

(58) Field of Classification Search
CPC ..... A42B 3/22; A42B 3/227; A42B 3/0406; A42B 3/221; A42B 1/006; A42B 1/247; (Continued)

(56) References Cited

U.S. PATENT DOCUMENTS 128,780 A 7/1872 Battle
1,030,173 A 6/1912 Haggerty
(Continued)

FOREIGN PATENT DOCUMENTS

JP 2011111683 A 6/2011
KR 200320527 Y1 7/2003
(Continued)

OTHER PUBLICATIONS

PCT International Preliminary Examination Report for PCT/US2012/070496 dated Apr. 25, 2013.
(Continued)

*Primary Examiner* — Jillian K Pierorazio
(74) *Attorney, Agent, or Firm* — Batt IP A Law Corporation; Richard Batt

(57) ABSTRACT

A portable brim can be securely attached to and operate with various helmets such as bicycle, skateboarding, snow sport, mountain/rock climbing, equestrian, and paddlesport helmets as well as hard hats used in construction, utility maintenance, material moving, dock loading, and airport baggage handling, to give the wearer shade and protection from the sun. The brim apparatus includes a center section having a size for fitting about a circumference of the sports helmet and a visor outwardly or radially extending from the center section. In one brim apparatus the center section features a stop surface that opposes an upper surface of the visor when the apparatus is affixed to the headgear such that the visor is prohibited from flipping upwards or sliding down or coming off during use.

19 Claims, 17 Drawing Sheets

Related U.S. Application Data continuation of application No. 15/421,399, filed on Jan. 31, 2017, now Pat. No. 11,375,765, which is a continuation of application No. 14/869,913, filed on Sep. 29, 2015, now Pat. No. 9,578,918, which is a continuation of application No. 13/400,309, filed on Feb. 20, 2012, now Pat. No. 9,149,085.

(60) Provisional application No. 61/480,004, filed on Apr. 28, 2011, provisional application No. 61/445,031, filed on Feb. 21, 2011.

(58) Field of Classification Search
CPC ..... A42B 1/0182; A42B 1/18; A42B 1/0186; A44B 11/008; Y10T 24/316
See application file for complete search history.

(56) References Cited

U.S. PATENT DOCUMENTS 1,179,631 A 4/1916 Hurd
1,238,615 A * 8/1917 Wolf ..... A42B 1/02 2/175.5
1,283,357 A * 10/1918 Thompson ..... A45D 20/02 2/200.1
1,337,506 A 4/1920 Chew
1,410,216 A 3/1922 Newman
1,423,829 A * 7/1922 Sulius ..... A42B 1/22 2/195.2
1,461,623 A * 7/1923 Lebow ..... A42B 1/22 2/195.2
1,501,654 A 7/1924 Fischer
1,557,762 A * 10/1925 Macleod ..... A42B 1/22 2/181.8
1,562,241 A * 11/1925 Millsaps ..... A42B 1/22 2/195.2
1,646,193 A * 10/1927 Farkas ..... A42B 1/18 428/4
1,726,936 A * 9/1929 Turgeon ..... A42B 1/18 2/175.6
2,020,582 A 11/1935 Shapiro
2,156,251 A * 4/1939 Carlson ..... A42B 1/22 2/175.1
2,230,805 A * 2/1941 Levy ..... A42B 1/0187 2/172
2,329,586 A 9/1943 Broudy
D136,471 S 10/1943 Wulsin
2,416,062 A * 2/1947 Mercer ..... A42B 1/205 2/200.1
2,446,288 A * 8/1948 Lindley ..... A42B 1/0187 2/195.5
2,478,550 A 8/1949 Smith
2,495,041 A 1/1950 Manfred
2,845,289 A 7/1958 Cicogna
2,867,816 A 1/1959 Rossett
3,166,766 A * 1/1965 Banello, Jr. ..... A42B 1/18 2/209.13
3,469,264 A * 9/1969 Harris ..... A42B 1/06 2/172
D246,681 S 12/1977 Hursh
4,316,289 A * 2/1982 Hild ..... A42B 3/227 2/10
4,776,042 A 10/1988 Hanson et al.
4,833,734 A * 5/1989 Der Estephanian ... A41D 20/00 2/22
4,887,319 A 12/1989 Daniels
4,993,079 A * 2/1991 Johnson ..... A42B 7/00 2/418
4,993,081 A * 2/1991 Fulghum ..... A42B 3/227 2/209.12
5,003,639 A 4/1991 White
5,062,163 A * 11/1991 Avey ..... A42B 1/0187 2/909
5,091,995 A * 3/1992 Oates ..... A42B 1/12 2/200.1
5,307,582 A 5/1994 Quintel
5,341,516 A 8/1994 Keim
5,406,645 A * 4/1995 Lin ..... A42B 1/24 2/10
5,487,191 A 1/1996 Ridley
5,519,895 A 5/1996 Barnes, Jr.
5,548,846 A * 8/1996 Bianchetti ..... A42B 1/0184 2/209.12
5,623,732 A * 4/1997 Olajide, Jr. ..... A42B 1/0187 2/202
D379,679 S * 6/1997 Poole ..... D29/104
5,669,071 A 9/1997 Vu
D385,091 S 10/1997 Rodgers
5,715,534 A 2/1998 Mobley
5,727,250 A * 3/1998 Black ..... A42B 3/227 2/10
5,799,335 A 9/1998 Ethier
5,862,520 A * 1/1999 Wyant ..... A42B 1/0182 2/10
5,875,493 A * 3/1999 MacDonald ..... A42B 1/205 2/171.1
5,887,287 A * 3/1999 Potochnik ..... A42B 1/241 2/172
5,896,587 A 4/1999 Gentry
5,920,909 A * 7/1999 Ellsworth ..... A42B 1/041 132/273
5,937,439 A 8/1999 Barthold et al.
6,009,555 A * 1/2000 Siprut ..... A42B 1/247 2/209.3
6,070,270 A 6/2000 De La
6,081,933 A * 7/2000 Partsch, IV ..... A42B 3/227 2/422
6,151,712 A 11/2000 Lampi
6,230,331 B1 5/2001 Aguilar et al.
6,237,162 B1 5/2001 Gill
6,260,204 B1 * 7/2001 Morrissey ..... A42B 3/003 2/172
6,263,508 B1 7/2001 Davis
6,308,336 B1 10/2001 Stephenson et al.
6,311,332 B1 11/2001 Lien
6,374,423 B1 * 4/2002 Anderson ..... A63B 71/10 2/209.12
6,467,096 B1 * 10/2002 Coluccio ..... A42B 1/22 2/195.2
6,473,907 B1 11/2002 Harwood
6,484,323 B1 * 11/2002 Pu ..... A42B 1/24 2/171.1
6,694,525 B1 2/2004 Murnan
6,889,391 B1 * 5/2005 Hitchins ..... A42B 3/227 2/200.1
6,966,074 B2 11/2005 Huh et al.
D524,517 S 7/2006 Javits, Jr.
D525,015 S 7/2006 Iwata
D525,413 S 7/2006 Javits, Jr.
7,406,721 B2 * 8/2008 Husbands ..... A42B 3/22 2/172
D593,732 S 6/2009 Tilley et al.
D594,185 S * 6/2009 Lacy ..... D2/879
7,690,052 B2 4/2010 Saladino
D617,539 S * 6/2010 Boles ..... D2/893
D623,831 S * 9/2010 Parsons ..... D2/882
D638,585 S * 5/2011 Brown ..... D29/122
8,042,198 B1 10/2011 Cleveland
8,051,497 B1 * 11/2011 Erhardt ..... A42B 1/206 2/172
D659,292 S 5/2012 Bryan et al.
D672,096 S 12/2012 Bryan et al.
D687,604 S * 8/2013 Bryan ..... D29/109
8,819,867 B1 9/2014 Boada
D720,502 S * 12/2014 Schrock ..... D29/122
D720,892 S 1/2015 Bryan et al.
D720,893 S 1/2015 Bryan et al.
D732,243 S 6/2015 Votel et al.
9,060,558 B2 6/2015 Dorman
9,078,483 B1 * 7/2015 Snyder ..... A42B 1/247
9,149,085 B2 10/2015 Bryan et al.

(56) References Cited

U.S. PATENT DOCUMENTS

| | | | | |
|---|---|---|---|---|
| 9,451,801 | B2 | 9/2016 | Bryan et al. | |
| 9,480,292 | B1 * | 11/2016 | Kazmierczak | A42C 5/04 |
| 9,578,918 | B2 | 2/2017 | Bryan et al. | |
| 10,362,827 | B2 | 7/2019 | Bryan et al. | |
| 11,375,765 | B2 | 7/2022 | Bryan et al. | |
| 2002/0004946 | A1 | 1/2002 | Nelson | |
| 2002/0029404 | A1 * | 3/2002 | Friedman | A42B 1/22 2/195.2 |
| 2004/0010832 | A1 | 1/2004 | Witkoff | |
| 2006/0048274 | A1 | 3/2006 | Lee | |
| 2006/0085891 | A1 * | 4/2006 | Larkin | A45D 8/36 2/171 |
| 2006/0174397 | A1 | 8/2006 | Taguchi | |
| 2006/0174398 | A1 | 8/2006 | Proctor | |
| 2008/0060117 | A1 * | 3/2008 | Timms | A42B 3/12 2/171 |
| 2008/0134414 | A1 * | 6/2008 | Cho | A42B 1/22 2/195.1 |
| 2009/0064394 | A1 * | 3/2009 | White | A42B 1/22 2/175.1 |
| 2009/0222975 | A1 | 9/2009 | Green et al. | |
| 2010/0031425 | A1 * | 2/2010 | Klamerus, Jr. | A42B 1/18 2/209.13 |
| 2010/0186147 | A1 * | 7/2010 | Garza | A42B 1/205 2/244 |
| 2011/0099691 | A1 * | 5/2011 | Duwyn-Zylstra | A42B 1/22 2/175.1 |
| 2011/0167544 | A1 * | 7/2011 | Kim | A42B 3/227 2/171.2 |
| 2012/0054936 | A1 * | 3/2012 | Cornell | A42B 3/227 2/9 |
| 2012/0210491 | A1 | 8/2012 | Bryan et al. | |
| 2012/0236544 | A1 * | 9/2012 | Dorman | G09F 21/026 2/244 |
| 2013/0047323 | A1 * | 2/2013 | Ireland | A42B 3/003 2/422 |
| 2013/0125292 | A1 * | 5/2013 | Weaver | A42B 1/006 2/209.13 |
| 2013/0180035 | A1 | 7/2013 | Lowther | |
| 2014/0189934 | A1 | 7/2014 | O'Connor et al. | |
| 2016/0242481 | A1 * | 8/2016 | Benshoof | A42B 1/22 |
| 2016/0353824 | A1 * | 12/2016 | Smith | A42B 1/208 |
| 2016/0374422 | A1 | 12/2016 | Denny | |
| 2017/0027265 | A1 * | 2/2017 | Bryan | A42B 3/221 |
| 2017/0290389 | A1 * | 10/2017 | Copeland | A42B 3/0406 |
| 2018/0146734 | A1 | 5/2018 | Kelly | |
| 2019/0166940 | A1 * | 6/2019 | Lybarger | A42B 1/0187 |
| 2019/0387827 | A1 * | 12/2019 | Hylton | A42B 1/0186 |
| 2020/0253311 | A1 * | 8/2020 | Niedermeyer | A42B 1/14 |

FOREIGN PATENT DOCUMENTS

| | | | |
|---|---|---|---|
| KR | 100690967 | B1 | 3/2007 |
| KR | 20090004131 | U | 5/2009 |
| WO | 2014061364 | A1 | 4/2014 |

OTHER PUBLICATIONS

PCT International Search Report for PCT/US2012/025788 dated Sep. 28, 2012.

PCT Written Opinion by ISA/KR for PCT/US2012/025788 dated Sep. 28, 2012.

* cited by examiner

BRIM FOR ATTACHING TO HEADGEAR

CROSS REFERENCE TO RELATED APPLICATIONS

The present invention is a continuation of U.S. patent application Ser. No. 17/844,016, filed Jun. 19, 2022, a continuation of U.S. patent application Ser. No. 15/421,399, now U.S. Pat. No. 11,375,765, filed Jan. 31, 2017, which is continuation of U.S. patent application Ser. No. 14/869,913, now U.S. Pat. No. 9,578,918, filed Sep. 29, 2015, which is a continuation of U.S. patent application Ser. No. 13/400,309, now U.S. Pat. No. 9,149,085, filed Feb. 20, 2012, which claims priority to patent application Nos. 61/445,031 filed Feb. 21, 2011; and 61/480,004 filed Apr. 28, 2011.

FIELD OF THE INVENTION

The present invention relates to an apparatus for use on headgear, such as helmets and hard hats.

BACKGROUND OF THE INVENTION

Certain headgear, such as various sports helmets, typically do not include a brim or visor, and, if they do, they are relatively small visors extending from the front of the helmet only. Such helmets rarely include visors extending around the entire circumference of the helmet. Hard hats may include a very small, inflexible full brim but this brim does not provide wide sun protection.

Outdoor sports, such as bicycling, skateboarding, snow skiing, snowboarding, mountaineering, rock climbing, equestrian, and paddling—are often done in areas without trees or other fixtures to provide shade. Participants encounter significant sun exposure while performing their respective activities even when using conventional helmets. Likewise, workers using hard hats often perform their duties in sunny locations and encounter significant sun exposure.

Sport helmets generally consist of a hard material and/or shock-absorbing material, such as foam, to protect the head from injury. Some may have a built-in brim; however they do not offer full, flexible brims around the entire helmet for sun protection. Some helmets offer no visor or brim at all. These brim-less or bill-less helmets are particularly problematic for fitting with a brim since no easy and secure attachment means for the visor, namely the short bill protrusion on billed helmets, exists. Furthermore, elongated bicycle helmets taper rapidly and are very broad at the front, making it difficult to attach and securely hold an aftermarket brim or visor onto the helmet with current technology. As such, protection of one's head from injury can come at the expense of sun protection and lack of shade. Additionally, helmets without any visor expose the wearer's eyes to glare and can make it difficult to see. Lack of a visor or brim on helmets or hard hats contributes to significant discomfort during inclement weather. Without a visor or brim on the helmet, rain and snow can easily reach the wearer's eyes, sunglasses, or prescription lenses, impairing vision.

One alternative option is to wear a baseball hat under the helmet or hard hat to provide shade while performing the outdoor activity. However, this practice does not allow for ventilation or adjustability of the brim. Additionally, full brim coverage is not provided. Such practice is cumbersome, often results in an improper fit of the helmet, and allows sweat and moisture to contact the skin.

A number of shades, caps, and helmets seek to provide sun protection including, U.S. Pat. Nos. 1,030,173; 5,519,895; 5,727,250; 6,260,204; 6,374,423; 6,889,391; 6,966,074; and 7,406,721; and U.S. Patent Publication Nos. 2002/004946 and 2004/0010832, 2011/0167544 each of which is incorporated by reference in its entirety. All patents and patent applications and non-patent publications recited herein are incorporated by reference in their entirety.

A brim apparatus for operating with sports headgear is often subjected to strong forces. A snowboarder or cyclist, for example, travels at great speeds and consequently subjects his helmet and brim to large winds which urge the brim to deflect or worse, flip up, thwarting a purpose of the brim, namely to block the sun.

Accordingly, there is a need for an apparatus that addresses the above mentioned challenges and that can be attached to a helmet and provide the wearer with shade and protection from the sun, thereby reducing the risk of skin cancer. There is a need for an apparatus that can attach to, and operate with, headgear to provide the wearer with shade and protection from the sun despite the speed and conditions arising from the environment or sport.

SUMMARY OF THE INVENTION

One embodiment of the present invention is an apparatus that creates shade for the wearer when using a variety of headgear.

One embodiment of the invention comprises a portable brim that can be attached to, and operate with, headgear, including, but not limited to helmets, such as bicycle, skateboarding, snow sport, mountain/rock climbing, equestrian, and paddlesport helmets.

Another embodiment of the invention comprises a portable brim that can attach to, and operate with, headgear including but not limited to hard hats used in construction, utility maintenance, material moving, dock loading, and airport baggage handling, to give the wearer shade and protection from the sun. Another embodiment of the invention is a brim or visor that can be easily attached to and removed from the helmet or hard hat, without any modification to the helmet or hard hat itself.

Another embodiment of the invention is an apparatus for attaching to a sports helmet including a center section having an adjustable size for fitting about a circumference of the sports helmet and a visor radially extending from the center section. In one embodiment the center section is adapted to form a stop surface opposing an upper surface of the visor when the apparatus is affixed to the sports helmet such that the stop surface prohibits the visor from upward rotation.

In another embodiment of the invention a brim apparatus for attaching to headgear comprises a center section having a size for detachably fitting about a circumference of the headgear and a visor radially extending from the center section. The center section may have an adjustable or fixed size. The headgear type may vary and in one embodiment is a hard hat. In another embodiment the brim apparatus is configured for use with headgear such as a sports helmet including without limitation bill-less or blunt sports helmets. Bill-less helmets also include helmets in which the bill has been removed or detached.

In another embodiment the apparatus comprises a crown or cover detachably connected to the top of the center section so as to cover the top of the headgear or the wearer's head when the headgear is not worn. In this capacity, the apparatus serves dual purposes as a brim for a helmet and as a hat for the wearer's head.

In another embodiment the apparatus comprises a center section, a visor extending radially therefrom, and at least one tilt angle adjustment feature for adjusting the angle that the visor makes with the center section. In one embodiment, the tilt angle adjustment feature is situated to adjust the frontal region of the visor. However, tilt angle adjustment features may be disposed on the side, rear, and other locations of the center section to provide a tilt to the visor relative to the center section. Examples of tilt angle adjustment features include tethers, straps, rings, loop and hook fasteners, clips, Velcro straps, etc. In one embodiment, the tilt angle adjustment feature comprises a ring and Velcro.

In another embodiment the apparatus comprises a visor having lateral regions which are adjustable to curve upwards. In one embodiment, the lateral regions of the visor are curved upwards so as to resemble a cowboy hat.

In another embodiment the apparatus comprises a center section and a visor radially extending therefrom, wherein the center section is longer in the rear than in the front. The center section is adapted to snugly fit on the wearer's head. A crown may be secured to the top of the center section. In one embodiment, the crown is detachable.

In another embodiment the apparatus comprises a center section and a visor extending radially therefrom, and wherein the center section is adapted to snugly fit to headwear, such as, without limitation, baseball hats.

The description, objects and advantages of the present invention will become apparent from the detailed description to follow, together with the accompanying drawings.

DETAILED DESCRIPTION

Before the present invention is described in detail, it is to be understood that this invention is not limited to particular variations set forth herein as various changes or modifications may be made to the invention described and equivalents may be substituted without departing from the spirit and scope of the invention. As will be apparent to those of skill in the art upon reading this disclosure, each of the individual embodiments described and illustrated herein has discrete components and features which may be readily separated from or combined with the features of any of the other several embodiments without departing from the scope or spirit of the present invention. In addition, many modifications may be made to adapt a particular situation, material, composition of matter, process, process act(s) or step(s) to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

Reference to a singular item, includes the possibility that there are plural of the same items present. More specifically, as used herein and in the appended claims, the singular forms "a," "an," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. It is also to be appreciated that unless defined otherwise, all technical and scientific terms used herein have the same meaning as commonly understood by one of ordinary skill in the art to which this invention belongs.

Figure 1:
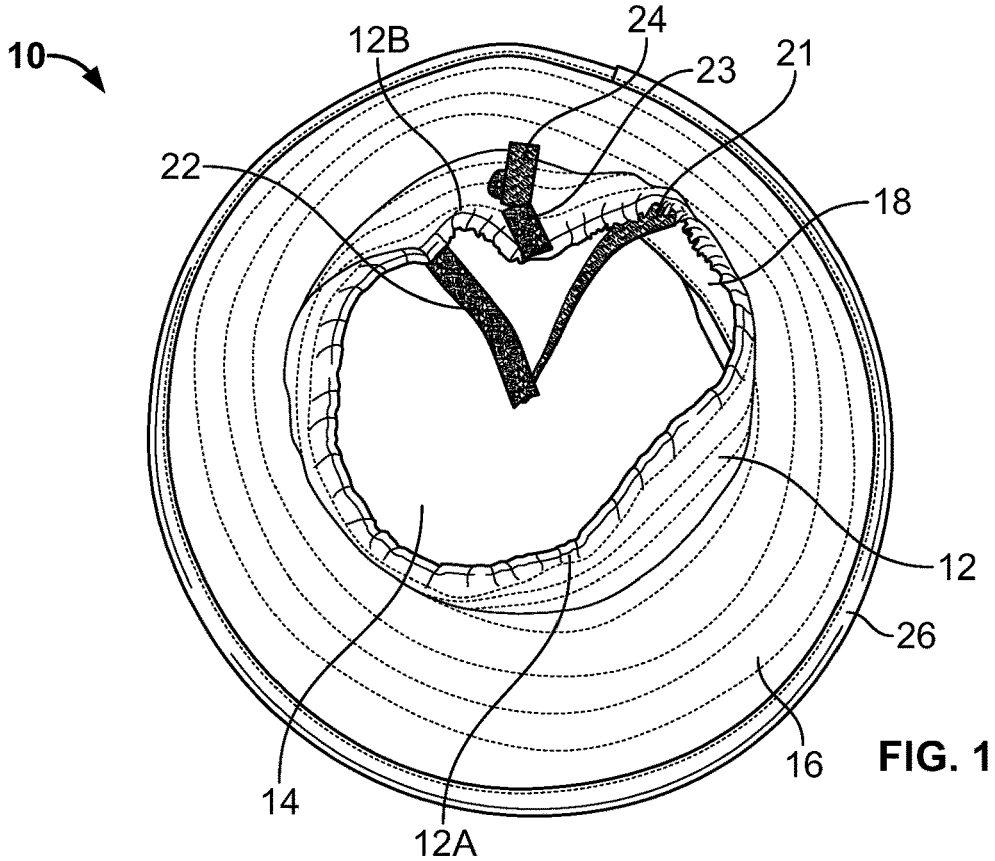
FIG. 1 is a top view of a brim apparatus according to a preferred embodiment of the invention.
Figure 2:
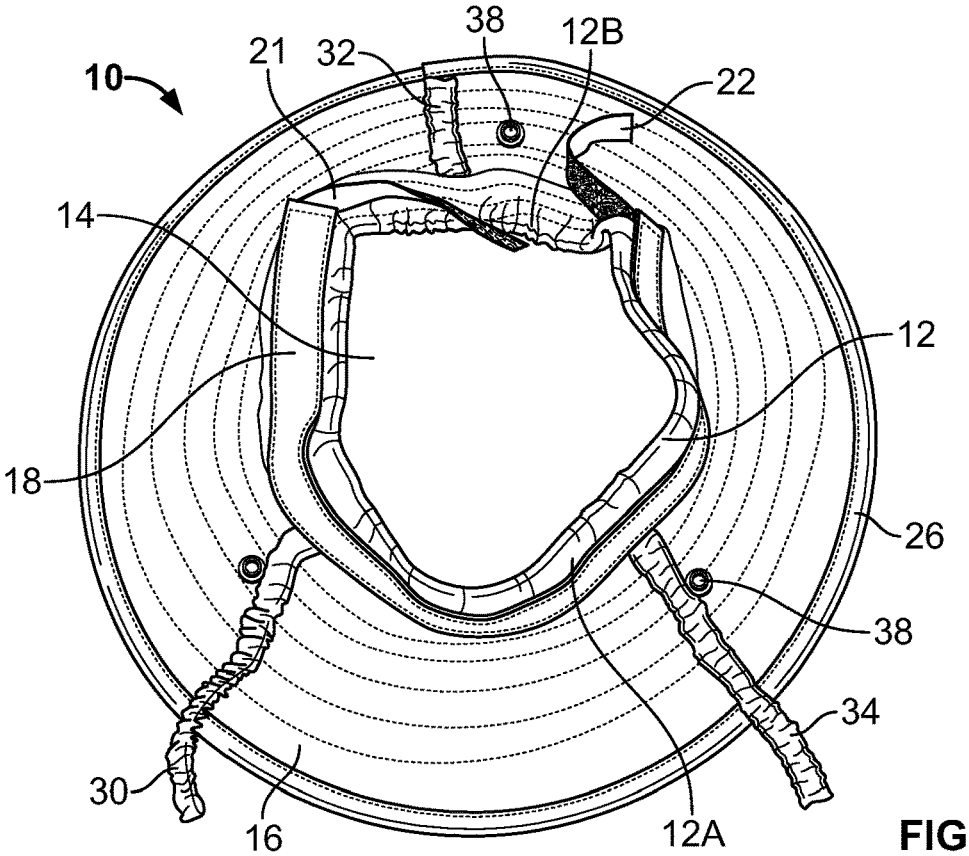
FIG. 2 is a bottom view of the brim apparatus of FIG. 1.

A brim apparatus for use on a bicycle helmet according to a preferred embodiment of the invention is illustrated in FIGS. 1-6, and shown generally at reference numeral 10. As shown in FIGS. 1 and 2, the apparatus 10 comprises a substantially oval flexible center section 12 defining an opening 14 sized to fit over a bicycle helmet 40. The opening is shown having a substantially oval shape. However, the shape may vary and may take other shapes such as a circular or another shape to fit a helmet.

The brim apparatus is shown having a visor 16. In the embodiment shown in FIGS. 1-6, the visor has a substantially oval shape. The visor 16 extends outwardly from the center section 12. The visor is shown spanning the entire circumference of the helmet, namely, 360 degrees, however, the arc angle may vary. In another embodiment, described herein, the visor span angle ranges from 0 to 180 degrees, and more preferably from 45 to 135 degrees, and more preferably from 80 to 100 degrees. The visor may radiate outwardly and may be directed at an angle from the center section slightly downwardly, or upwardly. In one embodiment, as will be discussed herein, the visor tilt angle may be adjusted to suit a user or increase his visibility.

The apparatus 10 can be made of cotton, or other suitable material such as nylon, polyester, cotton/polyester blends or water resistant material such as GORE-TEX or other membrane or treated fabric. The apparatus 10 is preferably made of a washable material, so that it can be washed after use. The visor 16 can be made of a stiff fabric interfacing, closed cell foam, lightweight plastic or other suitable material. For example, a fabric may cover or interface with one or more ribs or stiffeners, forming the desired shape such as visor shape 16. However, other shapes may be formed. Examples of stiffeners include without limitation tensioned rod, flexible plastic tubing, and spring steel.

The center section 12 is preferably elastic and has a section of anti-slip material 18 attached to the center section 12 for facilitating frictional engagement with helmet 40. The center section 12 can include means for adjusting the diameter of the opening 14 to accommodate helmets of varying size. As shown in FIGS. 1 and 2, the adjustment means can comprise two straps 21, 22 attached to the center section 12. One strap 21 has hook fasteners, while the other strap 22 has loop fasteners (or vice versa) for complementary engagement. As such, the diameter of the center section opening 14 can be adjusted by the user by varying the point of connection of the two straps 21, 22. Alternatively, the adjustment means can be a sliding strap or elastic.

The center section 12 has a front portion 12A and a rear portion 12B. Preferably, the rear portion 12B is greater in length than the front portion 12A to account for the relatively high positioning of bicycle helmets. The apparatus 10 can include adjustment means for adjusting the length that the rear portion 12B of the center section 12 drops down from the helmet 40. As shown in FIG. 1, the adjustment means can comprise a strap 23 attached to the rear portion 12B of the center section 12, and a strap 24 attached to the top surface of the visor 16 proximate the inner edge of the visor 16. The strap 23 on the center section 12 has loop fasteners, and the strap 24 attached to the visor 16 has hook fasteners for complementary engagement. Alternatively, the strap 23 on the center section 12 can have hook fasteners, and the strap 24 attached to the visor 16 can have loop fasteners. The distance that the rear portion 12B of the center section 12 extends down from the helmet can be adjusted by the user varying the point of connection of the two straps 23, 24. Alternatively the straps 23, 24 can be attached to the under surface of the center section 12 and visor 16, respectively.

As shown in FIGS. 1 and 2, a stiffening member, such as a plastic rod 26, is positioned at the outer edge of the visor 16 to help retain the shape of the visor 16. Alternatively, the stiffening member can be a square or flat wire or plastic rod, which would allow the apparatus 10 to be folded up similar to a windshield shade or band saw blade. With such a rigid and spring-loaded stiffening member 26, the visor 16 may consist of stretched fabric, and a supporting material, such as a stiff fabric interfacing, closed cell foam, lightweight plastic or other suitable material, need not be used.

Figure 3:
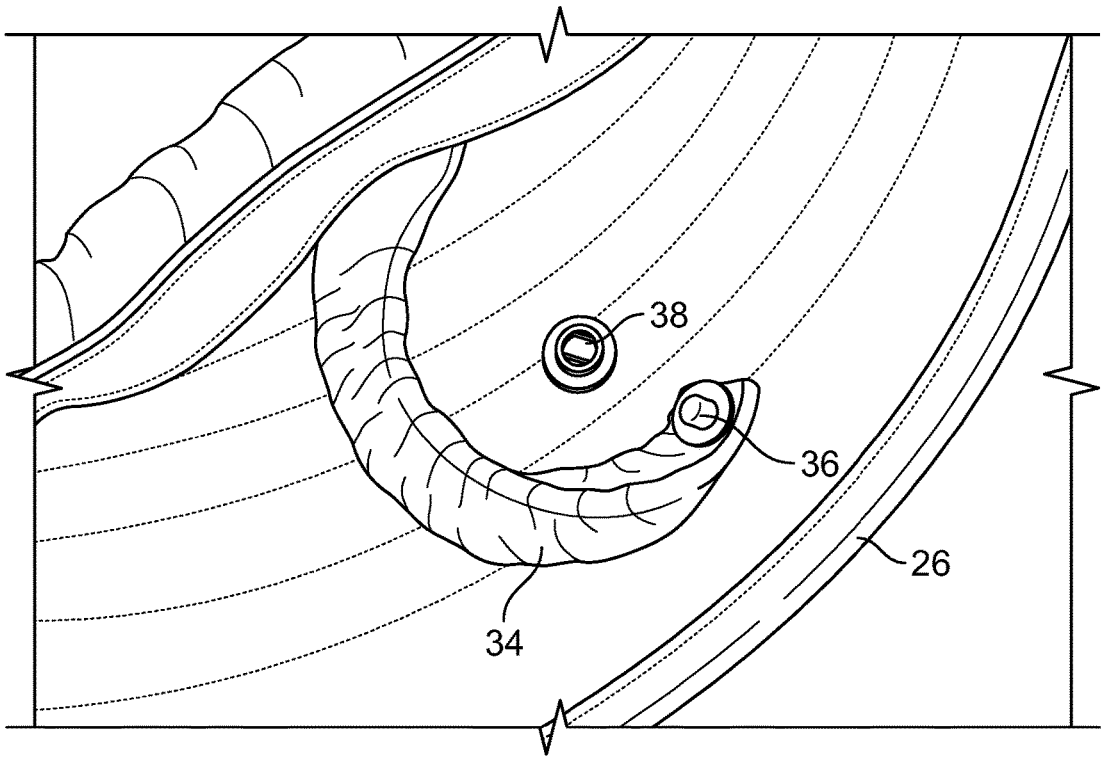
FIG. 3 is a partial perspective view of the brim apparatus of FIG. 1.

As shown in FIGS. 2 and 3, three elastic straps 30, 32, 34 are attached at the point of connection of the center section 12 and the inner edge of the visor 16. The male portion of a snap fastener 36 is attached to the end of each strap 30, 32, 34, and the complementary female portion of the snap fastener 38 is attached to the under surface of the visor 16. Alternatively, the female portion of the snap fastener can be attached to the straps 30, 32, 34, and the male portion can be attached to the visor 16. Also, other attachment means could be used, such as hook and loop fasteners or sliding straps.

Figure 4:
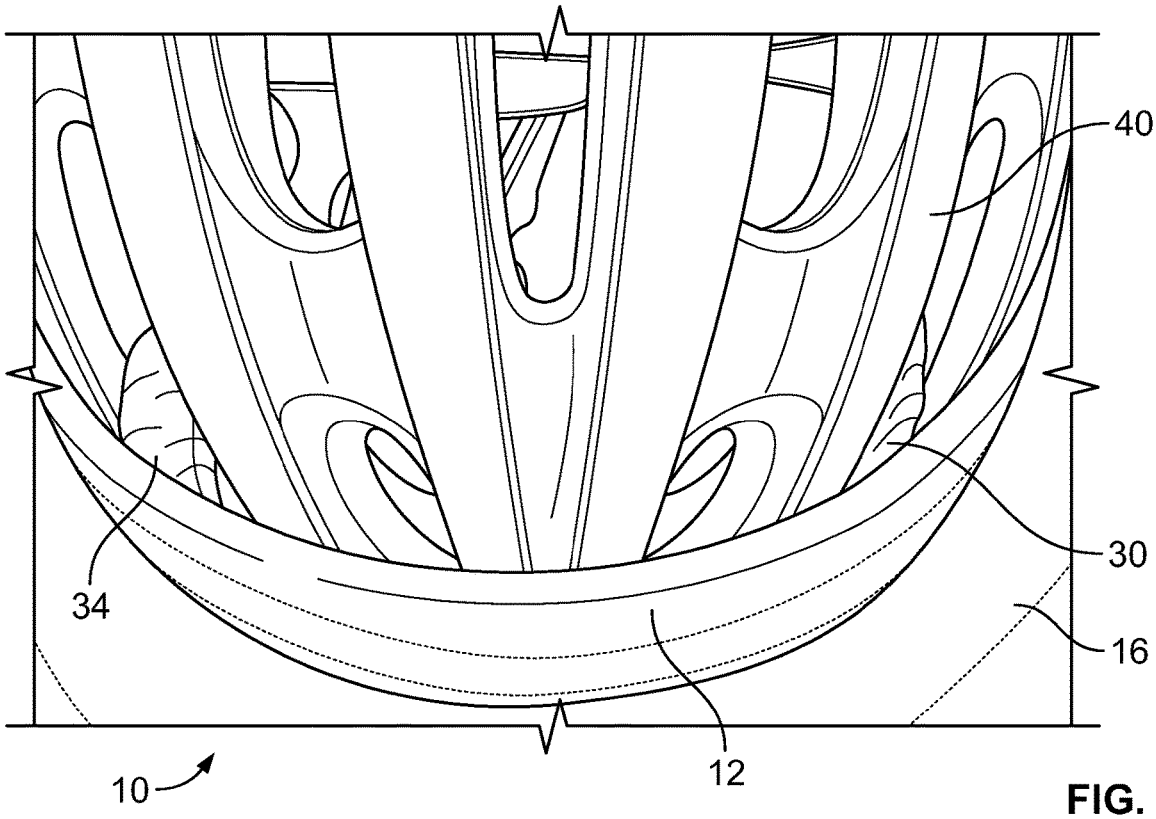
FIG. 4 is a partial perspective environmental view of the apparatus of FIG. 1.
Figure 5:
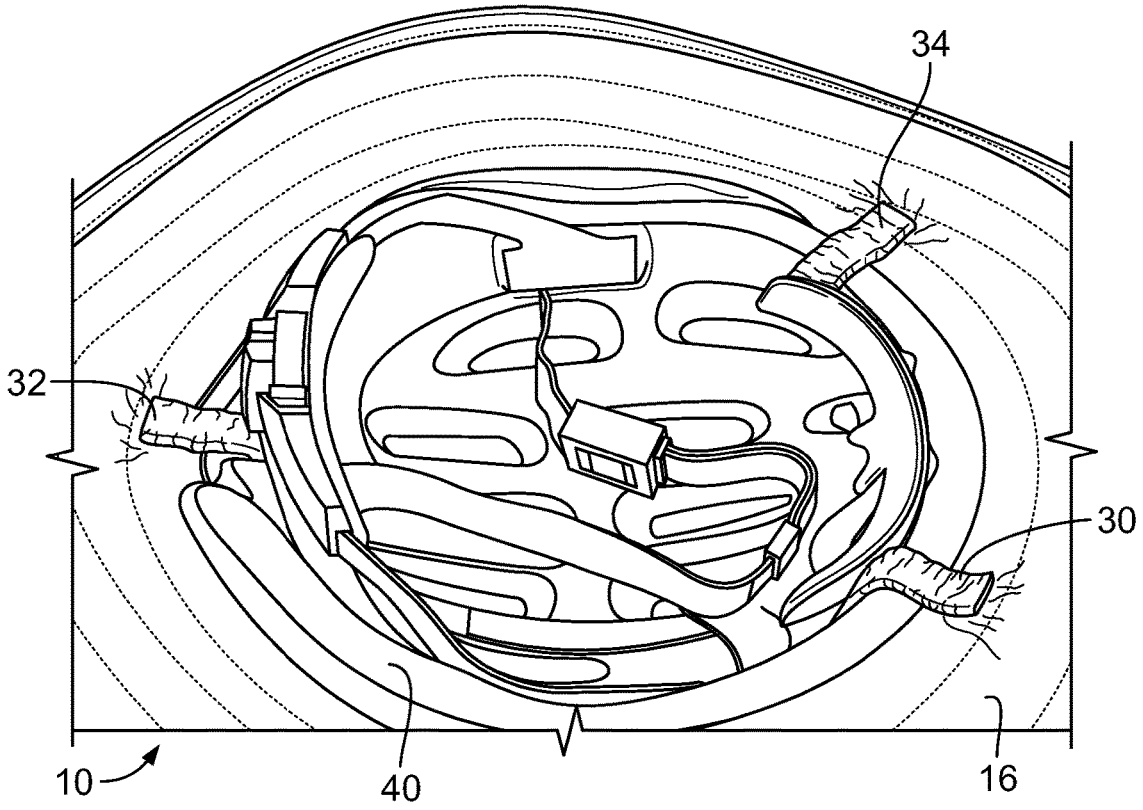
FIG. 5 is another perspective environmental view of the brim apparatus of FIG. 1.
Figure 6:
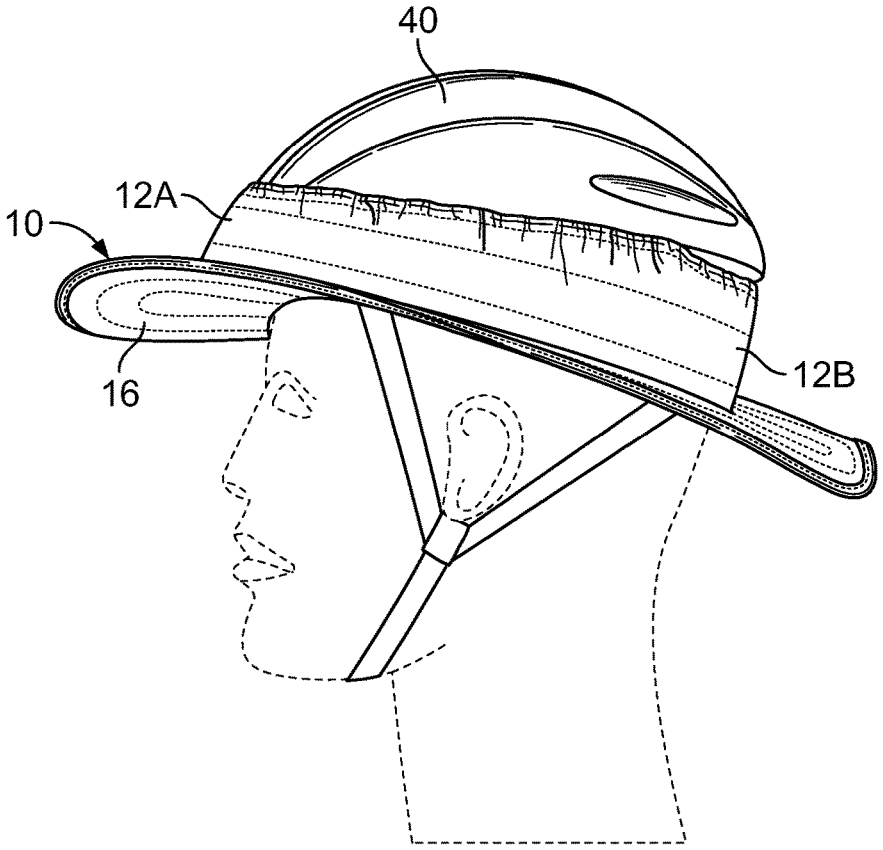
FIG. 6 is another perspective environmental view of the brim apparatus of FIG. 1.

In a preferred method of using the apparatus 10, the apparatus 10 is positioned over the bicycle helmet 40, the apparatus 10 is pulled over the helmet 40, which goes through the opening 14 of the center section 12 and engages the anti-slip section 18, as shown in FIG. 6. Each of the elastic straps 30, 32, 34 is positioned through a vent opening of the helmet 40, as shown in FIG. 4, and the male portions 36 of the snap fasteners on the straps 30, 32, 34, snap into the complementary female portions 38 positioned on the under surface of the visor 16, as shown in FIG. 5. The combination of the pro-friction/anti-slip material and the straps 30, 32, 34 securely retains the brim 10 on the helmet 40. The elastic straps, 30, 32, 34, can be tucked under the interior padding of the helmet for comfort, as shown in FIG. 5. It should be noted that on rounded helmets not having the classic oblong shape, use of the straps 30, 32, 34 may not be necessary to secure the brim 10.

The apparatus 10 fits snugly around the helmet 40, and does not impede any of the important functions of the helmet 40. Protective features of the helmet are preserved. In this embodiment of the present invention, there is complete encompassing of the helmet circumference, providing shade around its entirety. The brim apparatus 10 allows vents in the helmet 40 to be exposed and still used, and allows for the cooling features of the helmet to be preserved.

Figure 7:
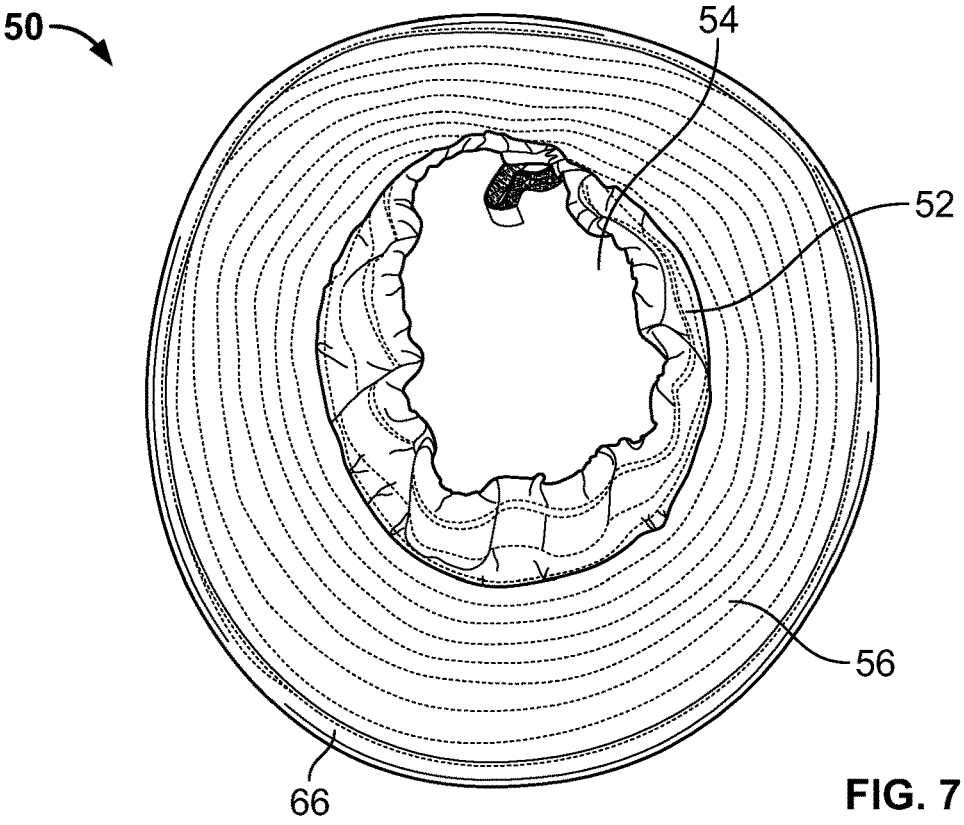
FIG. 7 is a top view of a brim apparatus according to another preferred embodiment of the invention.
Figure 8:
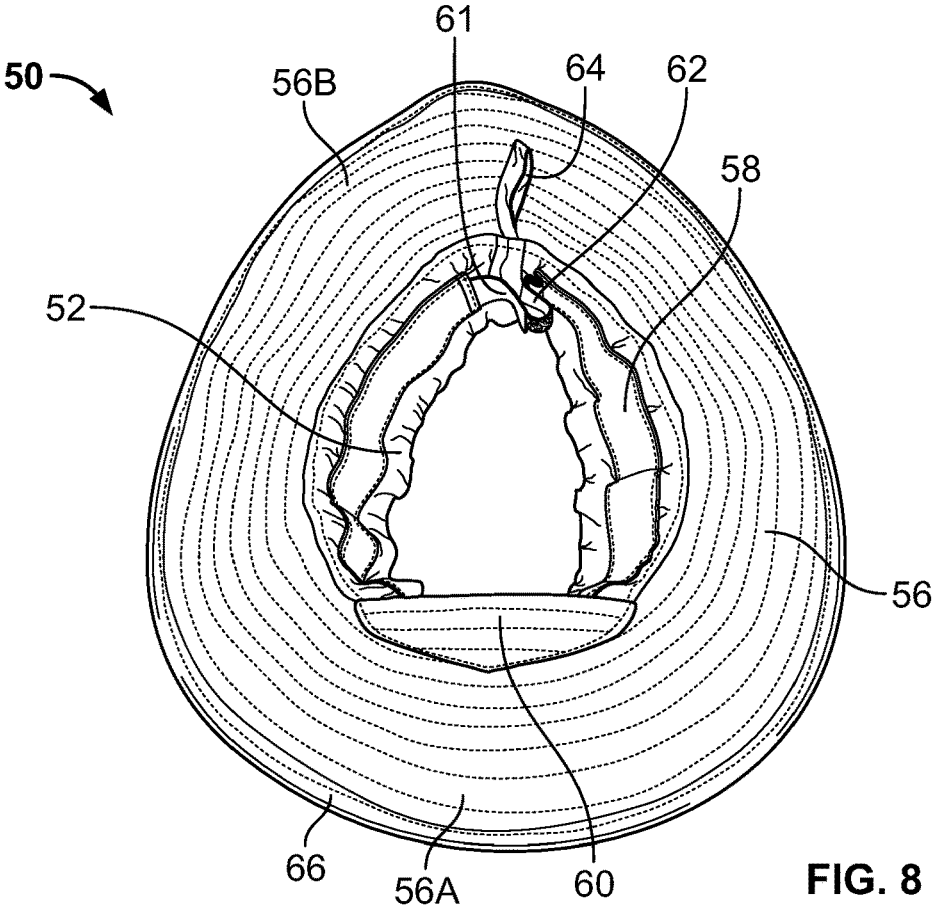
FIG. 8 is a bottom view of the brim apparatus of FIG. 7.
Figure 9:
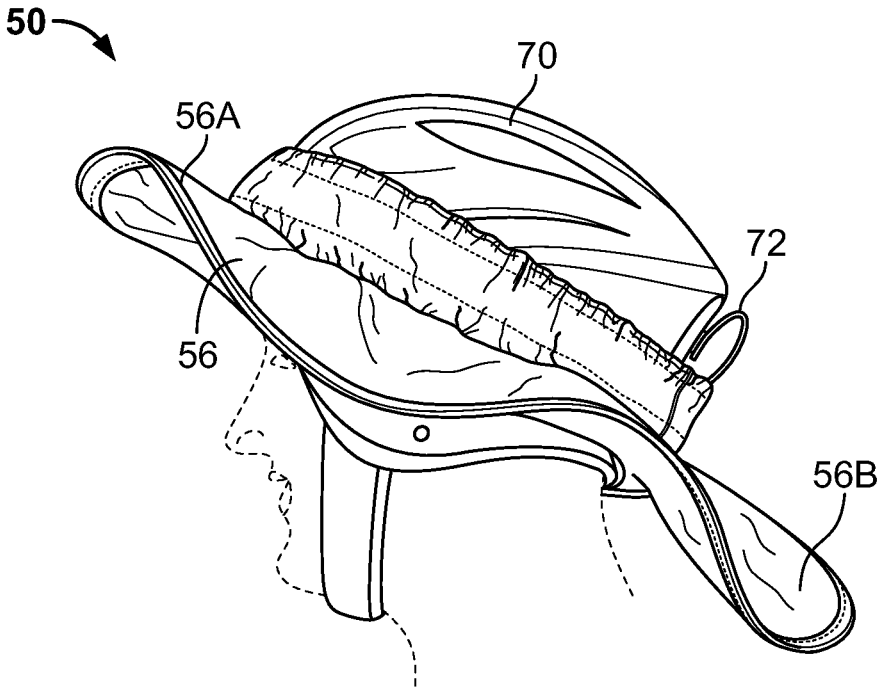
FIG. 9 is a perspective environmental view of the brim apparatus of FIG. 7.

A brim apparatus for use on a snow sports helmet according to another embodiment of the invention is illustrated in FIGS. 7-9, and shown generally at reference numeral 50. Examples of snow sports helmets include helmets used for skiing, snowboarding and other snow related activities. The apparatus 50 can be made of a fast drying material such as nylon, or other suitable material, including a water-resistant material such as GORE-TEX, or a material such as cotton or a cotton/polyester or polyester treated with a water resistant coating.

As shown in FIGS. 7 and 8, the apparatus 50 comprises a substantially oval flexible center section 52 defining an opening 54 sized to fit over a snow sports helmet 70, and a substantially oval visor 56 extending outwardly from the center section 52. The visor 56 is preferably made of closed-cell foam or other suitable material for water resistance. The underside of the visor 56 is preferably black to minimize the sunlight reflected from snow on the ground reflecting off the apparatus 50 and obstructing the user's view.

The center section 52 is preferably elastic and has a section of anti-slip material 58 for facilitating frictional engagement with the helmet 70. The anti-slip material is preferably compressible, or compressible in addition to being tacky. Exemplary materials for the anti-slip material include rubber, rubberized fabrics, foams, coated foams, combinations thereof, or another material suitable for facilitating frictional engagement with the headgear.

The center section 52 can include means for adjusting the diameter of the opening 54 to accommodate helmets of varying size. As shown in FIG. 8, the adjustment means can comprise two straps 61, 62 attached to the center section 52. One strap 61 can have hook fasteners, while the other strap 62 can have loop fasteners (or vice versa) for complementary engagement. As such, the diameter of the center section opening 54 can be adjusted by the user by varying the point of connection of the two straps 61, 62. Alternatively, the adjustment means can be a sliding strap or elastic.

The visor 56 has a front portion 56A and a rear portion 56B. Preferably, the rear portion 56B is longer than the front portion 56A to provide better coverage to the back of the neck of the user.

As shown in FIGS. 7 and 8, a stiffening member, such as a plastic rod 66, is positioned at the outer edge of the visor 56 to help retain the shape of the visor 56. Alternatively, the stiffening member can be a square or flat wire or plastic rod, which would allow the apparatus 10 to be folded up similar to a windshield shade or band saw blade. With such a rigid and spring-loaded stiffening member 66, the visor 56 may consist of stretched fabric, and a supporting material, such as a stiff fabric interfacing, closed cell foam, lightweight plastic or other suitable material, need not be used.

As shown in FIG. 8, a frontal reinforcing flap 60 can be attached at the inner edge of the underside of the front portion 56A of the visor 56. The front flap 60 helps prevent the apparatus 50 from coming off the helmet 70 when traveling at high speeds.

As shown in FIG. 8, a loop 64 can be attached at the inner edge of the underside of the rear portion 56B of the visor 56. As shown in FIG. 9, the loop can receive a goggle strap 72 of the snow sport helmet 70 to help retain the apparatus on the helmet 70 at high speeds, or in the case of a crash.

In a preferred method of using the apparatus 50, the apparatus 50 is positioned over the snow sports helmet 70, with the front portion 56A of the visor 56 above the front of the helmet 70, and the rear portion 56B of the visor 56 above the rear of the helmet 70. The apparatus 50 is pulled over the helmet 70 with the helmet 70 going through the opening 54 of the center section 52 and engaging the anti-slip section. The goggle strap 72 of helmet 70 is positioned through the rear loop 64, as shown in FIG. 9.

Figure 10:
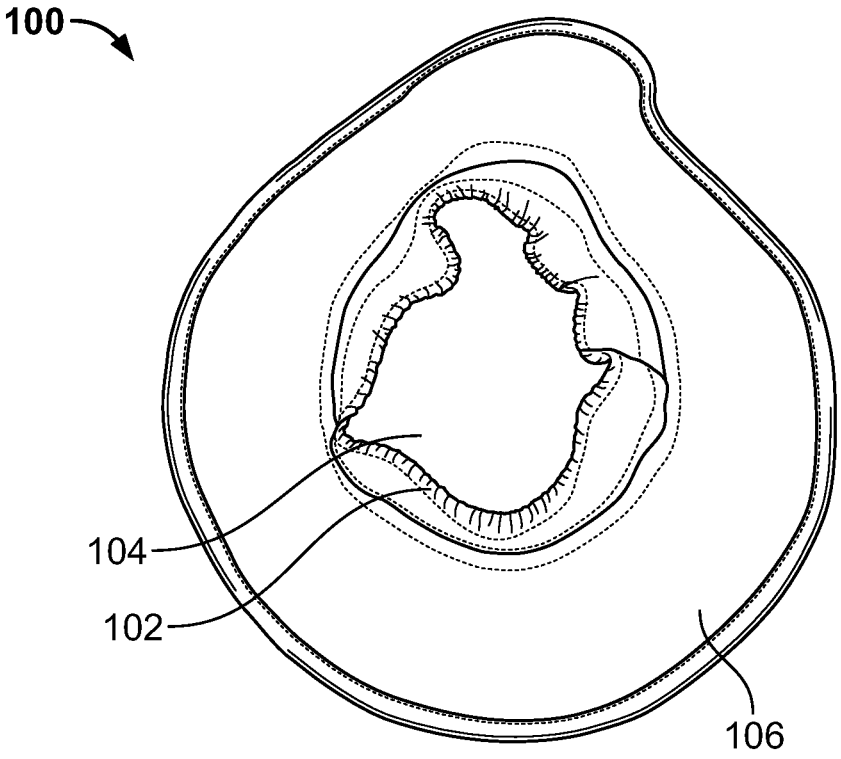
FIG. 10 is a top view of a brim apparatus according to another preferred embodiment of the invention.
Figure 11:
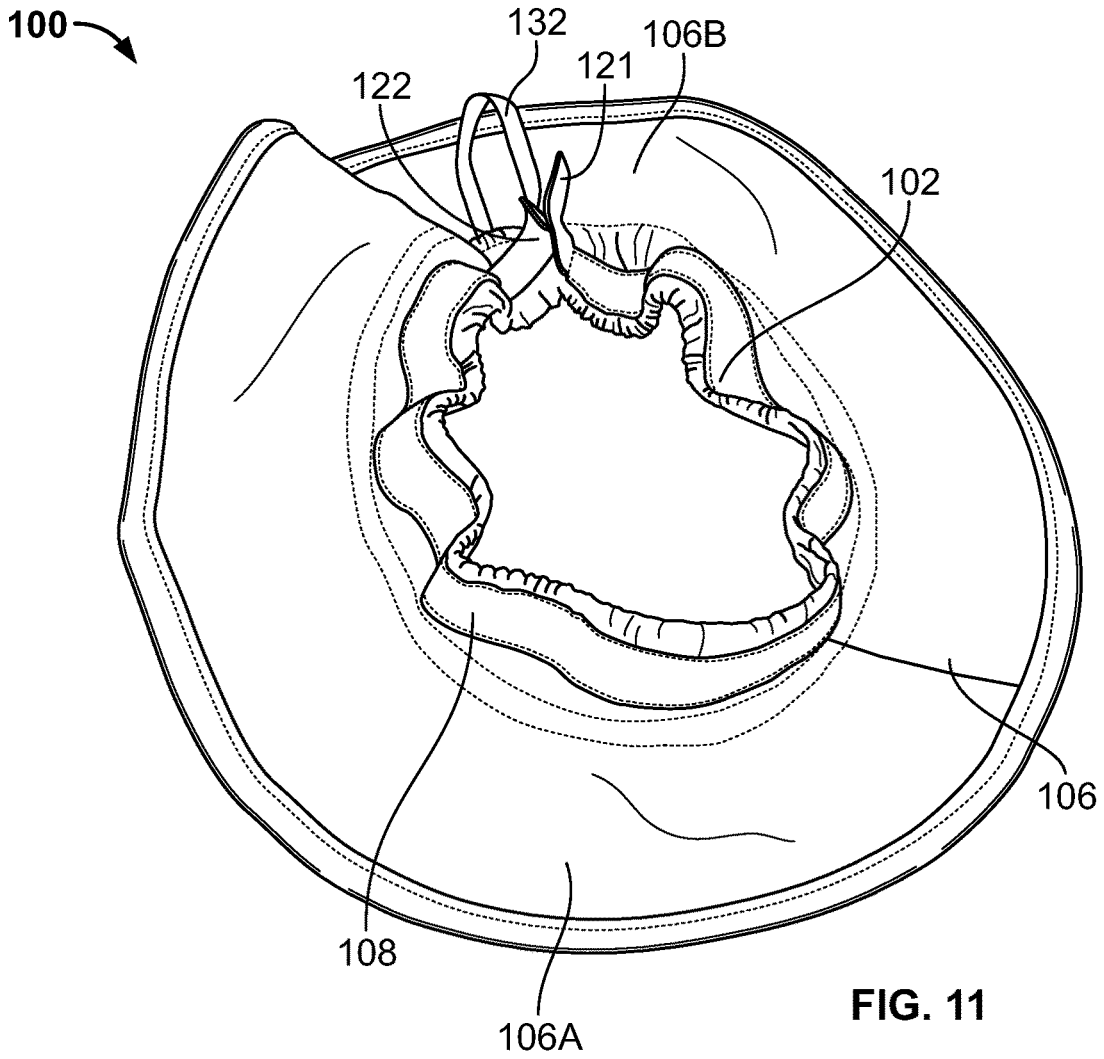
FIG. 11 is a bottom view of the brim apparatus of FIG. 10.
Figure 12:
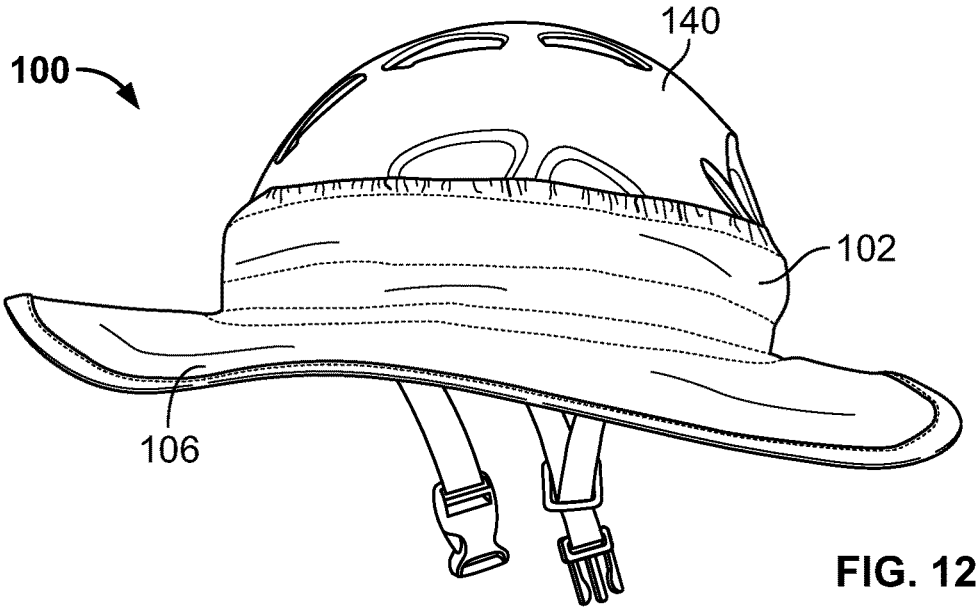
FIG. 12 is a perspective environmental view of the brim apparatus of FIG. 10.

A brim apparatus according to another embodiment of the invention is illustrated in FIGS. 10-12, and shown generally at reference numeral 100. This brim apparatus 100 is particularly suited for use with mountain/rock climbing helmets and/or equestrian helmets. The apparatus 100 can be made of cotton, or other suitable material such as nylon, polyester, cotton/polyester blends, GORE-TEX, treated or water resistant material, stiff fabric interfacing, closed cell foam, lightweight plastic, or other suitable material.

As shown in FIGS. 10 and 11, the apparatus 100 comprises a substantially oval flexible center section 102 defining a substantially oval opening 104 sized to fit over a mountain/rock climbing or equestrian helmet 140, and a substantially oval, flexible visor 106 extending outwardly from the center section 102.

The center section 102 shown in this embodiment is preferably elastic and has a section of anti-slip material 108 for facilitating frictional engagement with the helmet 140. The center section 102 can include means for adjusting the diameter of the opening 104 to accommodate helmets of varying size. As shown in FIG. 11, the adjustment means can comprise two straps 121, 122 attached to the center section 102. One strap 121 can have hook fasteners, while the other strap 122 can have loop fasteners (or vice versa) for complementary engagement. As such, the diameter of the center section opening 104 can be adjusted by the user by varying the point of connection of the two straps 121, 122. Alternatively, the adjustment means can be a sliding strap or elastic.

The visor 106 shown in this embodiment has a front portion 106A and a rear portion 106B. In an alternative embodiment designed specifically for use on equestrian helmets that already have visors as part of the helmet, the front portion 106A of the visor can be sewn so as to allow an integrated visor that is typically present on equestrian helmets to protrude there through. As shown in FIG. 11, a loop 132 can be attached at the inner edge of the underside of the rear portion 106B of the visor 106.

In a preferred method of using the apparatus 100, the apparatus 100 is positioned over the helmet 140, with the front portion 106A of the visor 106 above the front of the helmet 140, and the rear portion 106B of the visor 106 above the rear of the helmet 140. The apparatus 100 is pulled over the helmet 140, with the helmet 140 going through the opening 104 of the center section 102 and engaging the anti-slip section 108, as shown in FIG. 12. A hook and loop or sliding strap leash can be packaged with the apparatus 100, and positioned through the rear loop 132 and attached to the existing straps on the helmet 140. Also, a carabiner can be positioned through the rear loop 132, and used for carrying the apparatus 100. The brim apparatus 100 does not impede movement, and allows users to get close to rocks and other objects while climbing, and preserves proper helmet fit and function.

Figure 13:
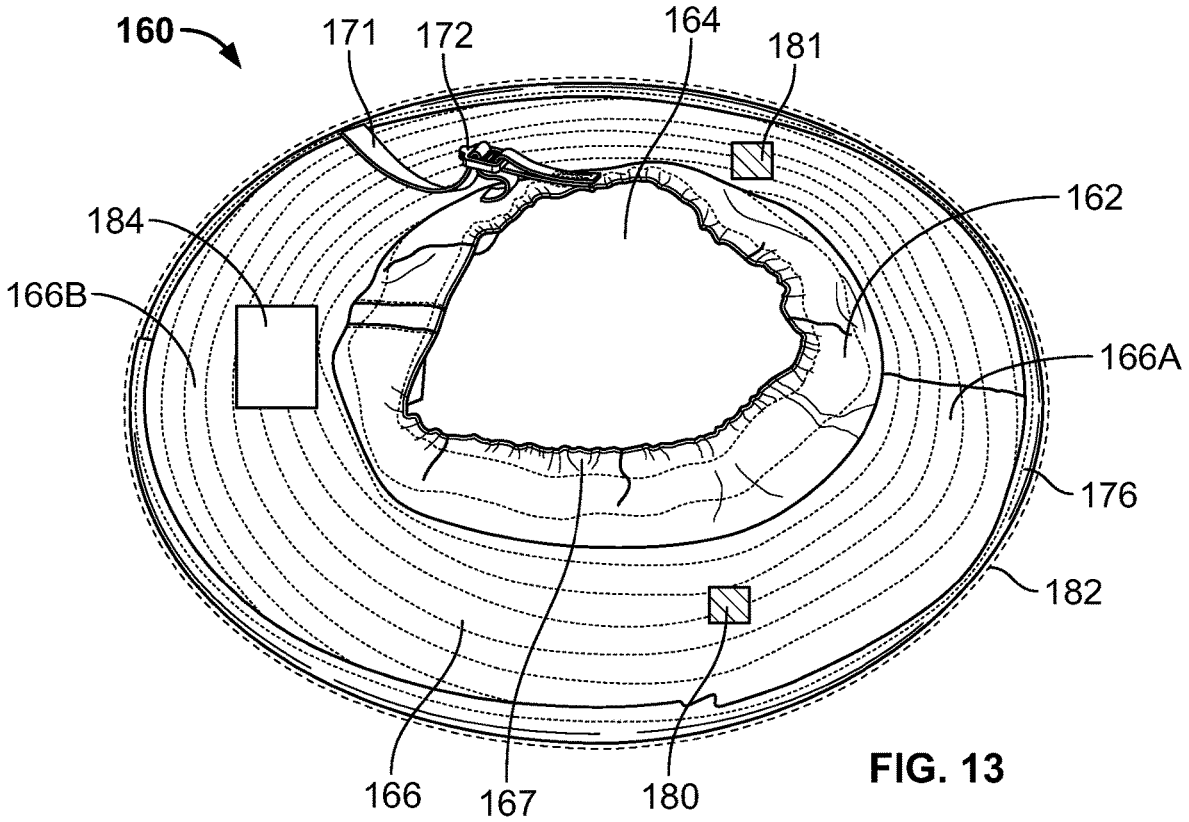
FIG. 13 is a top view of a brim apparatus according to another preferred embodiment of the invention.
Figure 14:
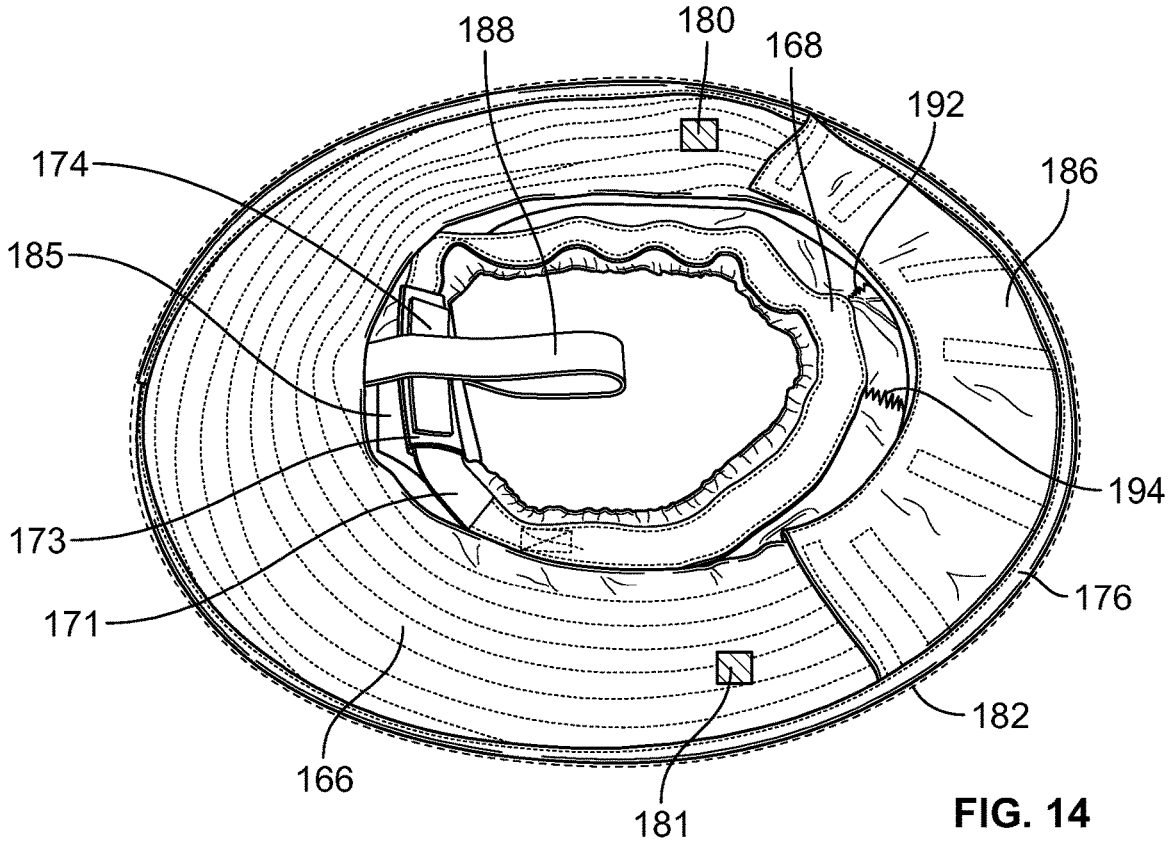
FIG. 14 is a bottom view of the brim apparatus of FIG. 13.

A brim apparatus for use on a multitude of different helmets is depicted in FIGS. 13-17 and shown generally at reference numeral 160. This embodiment could be used with a variety of sports helmets including, but not limited to, snow sports, rock climbing/mountaineering, skating, paddling, equestrian, and rounded bicycle helmets. This embodiment may also be used with various hard hats. As shown in FIGS. 13 and 14, the apparatus 160 in the figure has a substantially oval flexible center section 162 defining an opening 164 sized to fit over the headgear 198, and a substantially oval visor 166 extending outwardly from the center section 162. The apparatus 160 can be made of cotton, or other suitable material such as nylon, polyester, cotton/polyester blends or water resistant material such as GORE-TEX or treated fabric. The visor 166 can be made of a stiff fabric interfacing, closed cell foam, lightweight plastic or other suitable material.

The visor 166 has a front portion 166A and a rear portion 166B. Preferably, but not necessarily, the rear portion 166B is longer than the front portion 166A to provide better coverage to the back of the neck of the user.

The center section 162 preferably has an elastic portion 167 and has a section of anti-slip material 168 attached to the center section 162 for facilitating frictional engagement with helmet 198. The center section 162 can include a feature or means for adjusting the diameter of the opening 164 to accommodate helmets of varying size. As shown in FIGS. 13 and 14, the size adjustment feature can comprise a strap 171 and ladder lock buckle 172 attached to the center section 162. The strap 171 slides through a guide tube 173 that is attached near the top of the rear center section 162. As such, the diameter of the center section opening 164 can be adjusted by the user by varying the length of the strap 171 at the ladder lock buckle 172. One skilled in the art can appreciate that other means than a ladder lock buckle 162, such as a complementary engaging sliding buckle, hook and loop fastener strap, ring with an associated strap with hooks or buckles, or other suitable material, can be used for adjustment of strap length. Furthermore, a guide tube 173 is not necessarily required and other alternatives such as a channel in the center section 162, a loop, or no guide if the span is small, could be used. A section of anti-slip material 174 may also be present on the guide tube 173.

As shown in FIGS. 13 and 14, a stiffening member, such as a plastic rod, is positioned at the outer edge of the visor 176 to help retain the shape of the visor 166. Alternatively, the stiffening member can be a square or flat wire or plastic rod, which would allow the apparatus 160 to be folded up similar to a windshield shade or band saw blade. With such a rigid and spring-loaded stiffening member, the visor 166 may consist of stretched fabric, and a supporting material, such as a stiff fabric interfacing, closed cell foam, light-weight plastic or other suitable material, need not be used.

As shown in FIGS. 13 and 14, the visor 166 may have vents 180, 181 that allow air to flow through them when traveling at high speed. Any number of vents 180, 181 may be used and positioned at any location on the visor 166. Vents 180, 181 may be passive as holes or may be active and open as air flows there through. Additionally, the visor 166 may be made of a mesh material without a covering and allow air to flow there through. The vents may have a wide variety of shapes. In one embodiment a vent is shaped as one of the following including an oval, circle, square, or slit. The vent reduces lift and pressure on the visor when moving at speed or in windy conditions.

As shown in FIGS. 13 and 14, the visor may have an accessory attachment 182 positioned at the edge of the visor 166 to allow for complementary engagement of accessories, such as fabric curtains, mosquito netting, or other suitable accessories. The accessory attachment 182 may consist of complementary engaging zippers, hook and loop fasteners, snaps, or other suitable materials to facilitate attachment of accessories with the complementary engaging zippers, hook and loop fasteners, snaps, or other suitable materials to the apparatus 160.

The brim apparatus shown in FIG. 13 also includes a pocket 184. The pocket 184 may serve to hold and conceal a foldable cover that can be unfolded from the pocket and used to cover the helmet 198. Such a cover may be useful in the case of inclement weather.

FIG. 14 depicts a reinforcement piece 185 at the rear of the center section 162. This reinforcement piece prevents the center section 162 from flopping as the user experiences high winds or goes over uneven terrain.

Figure 15:
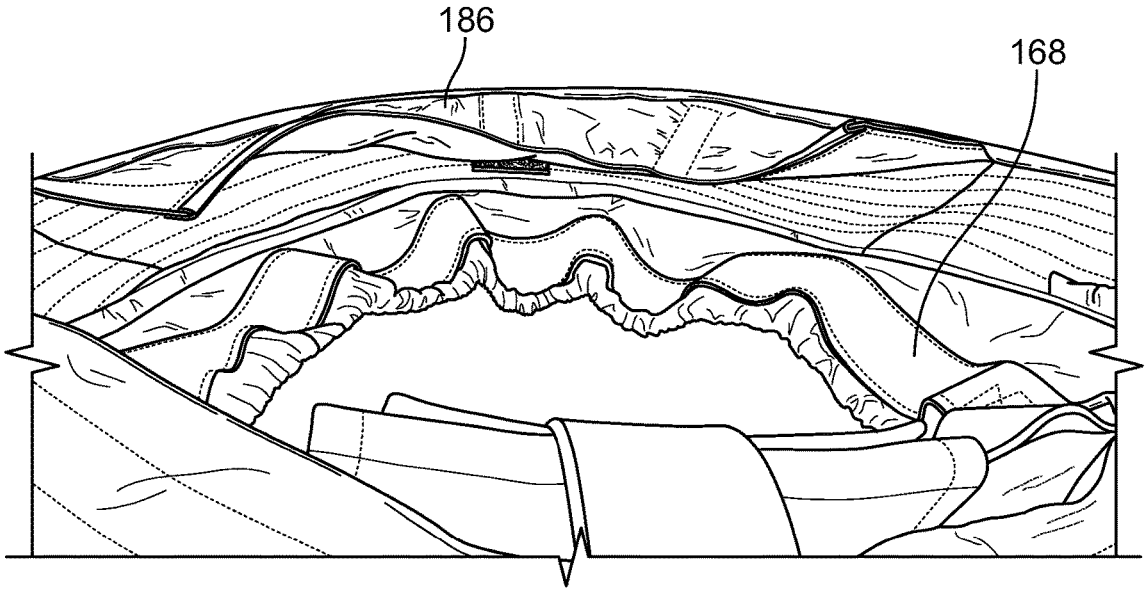
FIG. 15 is a partial perspective view of the brim apparatus of FIG. 13.
Figure 17:
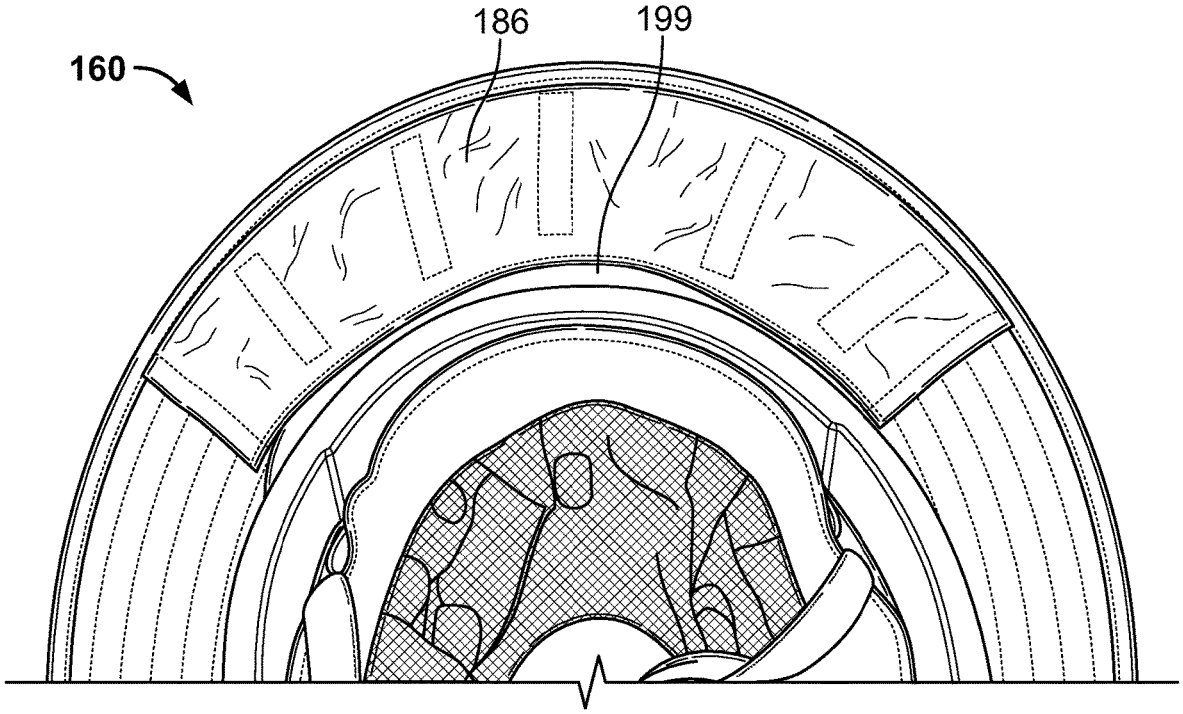
FIG. 17 is a partial perspective environmental view of the brim apparatus of FIG. 13.

As mentioned previously, some helmets and hard hats have a visor that is pre-integrated or molded into the headgear itself. As shown in FIGS. 14, 15, and 17, the apparatus 160 can have a pocket 186 for receiving a pre-existing visor 199 that was previously integrated with the helmet. The pocket 186 may be closed around the pre-existing visor 199 using hook and loop fasteners attached to opposite sides of the inner surface of the pocket, or other suitable device, to form a clamp. The pocket therefore creates a clamp, preventing the visor from rotation and from coming off the headgear.

Figure 16:
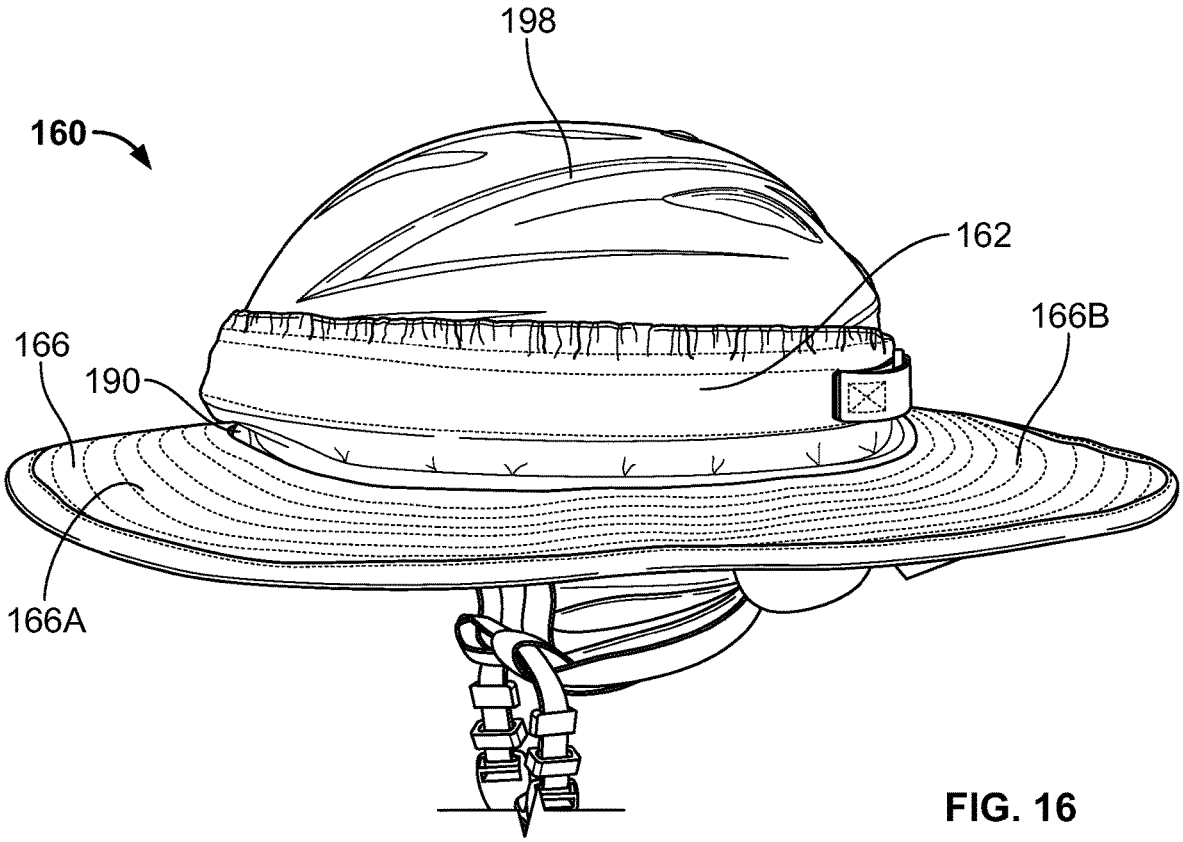
FIG. 16 is a perspective environmental view of the brim apparatus of FIG. 13.

As shown in FIG. 14, a loop 188 can be attached at the inner edge of the underside of the rear portion 166B of the visor 166. As shown in FIG. 16, the loop 188 can receive a goggle strap of the helmet 198 or may be attached to an existing helmet strap by opening the loop and refastening it into a closed shape. This loop 188 can be used to retain the apparatus 160 on the helmet. This loop may be used to retain tools.

FIG. 16 shows a brim apparatus 160 positioned over a sports helmet 198, with the front portion 166A of the visor 166 above the front of the helmet 198, and the rear portion 166B of the visor 166 above the rear of the helmet 198. The apparatus 160 is pulled over the helmet 198, with the helmet 198 going through the opening 164 of the center section 162 and engaging the anti-slip section. When the apparatus 160 is affixed to the sports helmet, the center section 162 is adapted to form a stop surface 190, wherein the stop surface 190 prohibits the visor 166 from upward rotation. When affixed to the helmet, the center section clamps the apparatus onto the helmet and prevents upward or downward rotation and the brim from coming off the helmet. The center section may form a shelf on which a portion of the underside of the helmet may sit. The other side of the stop surface on the center section contacts a portion of the underside of the helmet when the apparatus is affixed to the helmet.

The stop surface shown in FIG. 16 arises from the design of the brim apparatus and is based on the geometry of the apparatus with respect to the headgear. As shown in FIG. 14, center section is shown with at least one visor spatial control member 192, 194 which serves to control the spacing of the visor relative to the helmet when the brim is properly attached to the helmet. In the variation of the invention shown in FIG. 14, visor spatial control feature includes two stitches 192, 194. However, other examples of a visor spatial control feature include but are not limited to clips, staples, ties, etc. The spatial control feature may not be externally visible and can be hidden during manufacture of the apparatus. When the helmet is engaged with the brim apparatus, in this embodiment, the visor spatial control feature serves to shift rearward the visor, creating the stop surface 190, regardless of the size of the helmet.

The spatial control feature may vary. As an alternative to the spatial control member 192, 194 shown in FIG. 14, the center section 162 can be shortened relative to the inner circumference of the visor 166 to preserve functionality of the stop surface 190 when the apparatus 160 is placed on a helmet.

The goggle strap of helmet 198 is positioned through the rear loop 188. When the apparatus 160 is used with a helmet or hard hat that has a pre-integrated visor, the pre-integrated visor 199 is inserted into the pocket 186, as shown in FIG. 17. Attachment of the apparatus 160 to the helmet 198 proceeds similarly to that shown in FIG. 16.

Figure 18:
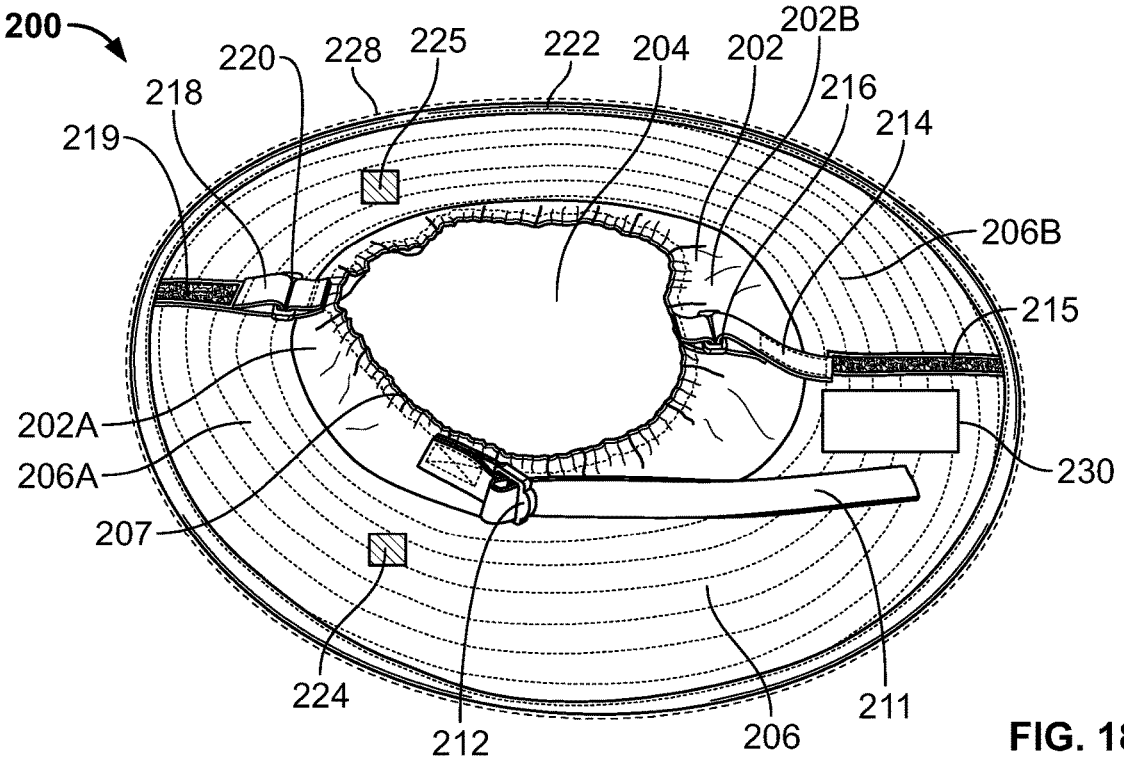
FIG. 18 is a top view of a brim apparatus according to another preferred embodiment of the invention.
Figure 19:
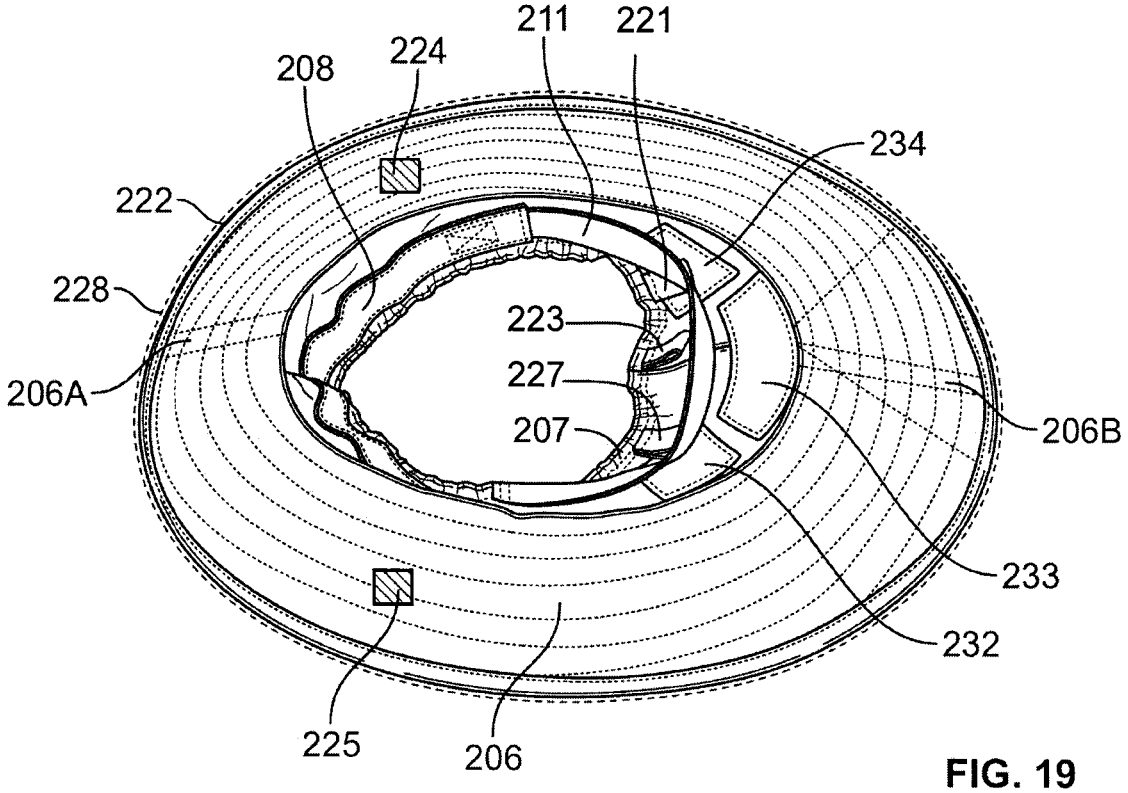
FIG. 19 is a bottom view of the brim apparatus of FIG. 18.

A brim apparatus according to another embodiment of the invention is illustrated in FIGS. 18-21, and shown generally at reference numeral 200. This embodiment of the invention is intended for use with bicycle helmets but could also be used with other headgear. As shown in FIGS. 18 and 19, the apparatus 200 comprises a substantially oval flexible center section 202 defining an opening 204 sized to fit over a bicycle helmet 250, and a substantially oval visor 206 extending outwardly from the center section 202. The apparatus 200 can be made of cotton, or other suitable material such as nylon, polyester, cotton/polyester blends or water resistant material such as GORE-TEX or treated fabric. The visor 206 can be made of a stiff fabric interfacing, closed cell foam, lightweight plastic or other suitable material.

The visor 206 has a front portion 206A and a rear portion 206B. Preferably, the rear portion 206B is longer than the front portion 206A to provide better coverage to the back of the neck of the user.

Figure 20:
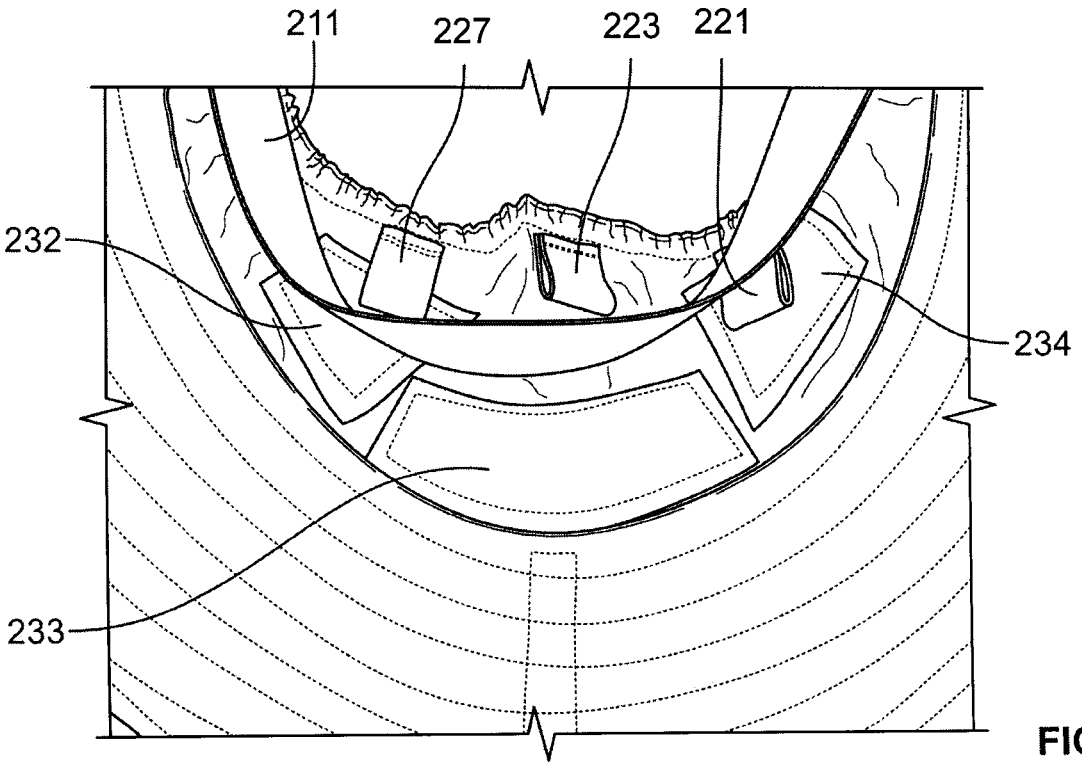
FIG. 20 is a partial perspective view of the brim apparatus of FIG. 18.

The center section has a front portion 202A and a rear portion 202B. Preferably, the rear portion 202B is greater in length than the front portion 202A to account for the relatively high positioning of bicycle helmets. On other helmets, the longer rear portion 202B helps to position the visor so that it provides better neck coverage. The center section 202 preferably has an elastic portion 207 and has a section of anti-slip material 208 attached to the center section 202 for facilitating frictional engagement with helmet 250. The center section 202 can include various features and means for adjusting the diameter of the opening 204 to accommodate helmets of varying size. As shown in FIGS. 18 and 19, the size adjustment feature can comprise a strap 211 and ladder lock buckle 212 attached to the center section 202. The strap 211 slides through any combination of guide straps 221, 223, 227 that are attached near the top of the rear center section 202B to accommodate different topological features of particular bicycle helmets, as shown in FIGS. 19 and 20. As such, the diameter of the center section opening 204 can be adjusted by the user by varying the length of the strap 211 at the ladder lock buckle 212. One skilled in the art can appreciate that other means than a ladder lock buckle 212, such as a complementary engaging sliding buckle, hook and loop fastener strap, ring with an associated strap with hooks or buckles, or other suitable material, can be used for adjustment of strap length.

The apparatus 200 has a vertical adjustment feature 214 to adjust the vertical position of the visor 206 relative to the center section 202. As shown in FIG. 18, the adjustment feature can consist of a hook and loop fastener strap 215 passed through a ring 216 that is attached near the top of the rear center section 202B. A sliding strap or other suitable means may also be used.

Figure 21:
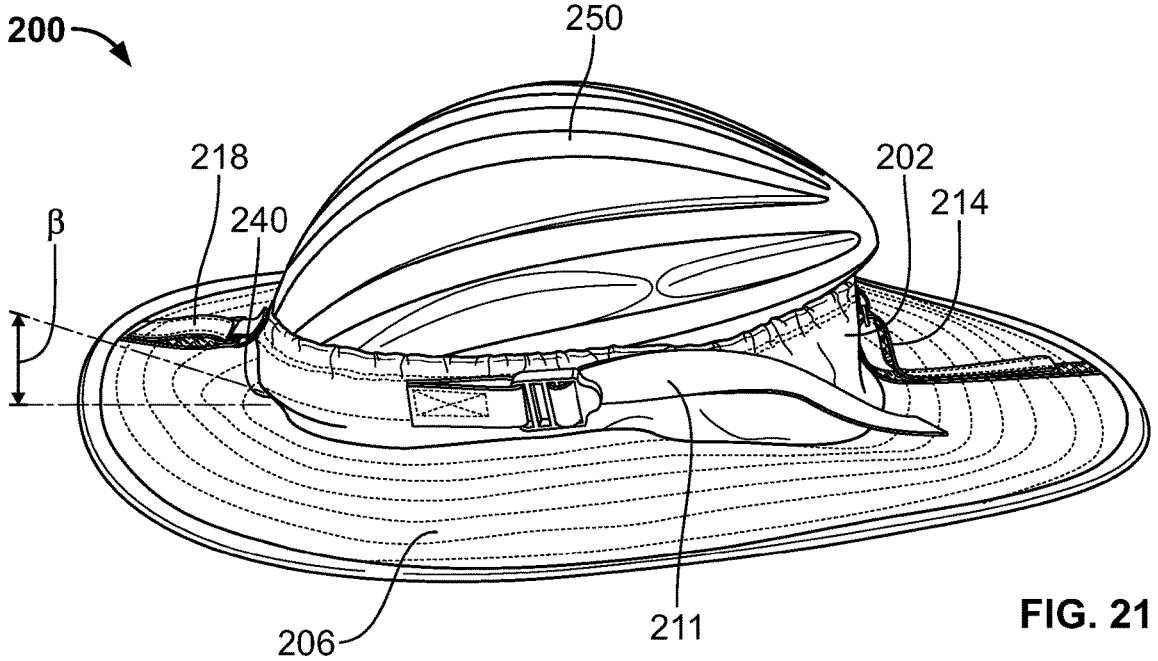
FIG. 21 is a perspective environmental view of the brim apparatus of FIG. 18.

The apparatus 200 also has a visor tilt angle adjustment feature 218 to adjust the angle at which the visor extends from the center section. As shown in FIG. 18, the adjustment feature can consist of a hook and loop fastener strap 219 passed through a ring 220 that is attached near the top of the front center section 202A. A sliding strap or other suitable means may also be used. The tilt angle (β) may vary and preferably ranges from −45 degrees to 70 degrees and more preferably −15 to 45 degrees. The tilt angle (β) is illustrated in FIG. 21 by reference symbol β.

As shown in FIGS. 18 and 19, a stiffening member, such as a plastic rod, is positioned at the outer edge of the visor 222 to help retain the shape of the visor 206. Alternatively, the stiffening member can be a square or flat wire or plastic rod, which would allow the apparatus 200 to be folded up similar to a windshield shade or band saw blade. With such a rigid and spring-loaded stiffening member, the visor 206 may consist of stretched fabric, and a supporting material, such as a stiff fabric interfacing, closed cell foam, lightweight plastic or other suitable material, need not be used.

As shown in FIGS. 18 and 19, the visor 206 may have vents 224, 225 that allow air to flow through them when traveling at high speed. Any number of vents 224, 225 may be used and positioned at any location on the visor 206. Vents 224, 225 may be passive as holes or may be active and open as air flows there through. Additionally, the visor 206 may be made of a mesh material without a covering and allow air to flow through the visor 206.

As shown in FIGS. 18 and 19, the visor may have an accessory attachment 228 positioned at the edge of the visor 222 to allow for complementary engagement of accessories, such as fabric curtains, mosquito netting, or other suitable accessories. The accessory attachment 228 may consist of complementary engaging zippers, hook and loop fasteners, snaps, or other suitable materials to facilitate attachment of accessories to the apparatus 200.

As shown in FIG. 18, a pocket 230 may conceal a foldable cover that can be unfolded from the pocket and used to cover the helmet 250. Such a cover may be useful in the case of inclement weather.

FIGS. 19 and 20 depict reinforcement pieces 232, 233, 234 at the rear of the center section 202B. This reinforcement piece prevents the center section 202 from extensively flopping as the user experiences high winds or goes over uneven terrain.

FIG. 21 shows a brim apparatus 200 positioned over bicycle helmet 250, with the front portion 206A of the visor 206 above the front of the helmet 250, and the rear portion 206B of the visor 206 above the rear of the helmet 250. The apparatus 200 is pulled over the helmet 250, with the helmet 250 going through the opening 204 of the center section 202 and engaging the anti-slip section 208. When the apparatus 200 is affixed to the bicycle helmet, the center section 202 is adapted to form a stop surface 240, wherein the stop surface 240 clamps the apparatus 200 to the helmet 250 and prohibits the visor 206 from upward rotation. When affixed to the helmet, the center section clamps the brim onto the helmet and prevents rotation and the brim from coming off the helmet. The center section may form a shelf on which a portion of the underside of the helmet may sit. The other side of the stop surface on the center section contacts a portion of the underside of the helmet when the apparatus is affixed to the helmet.

Figure 22:
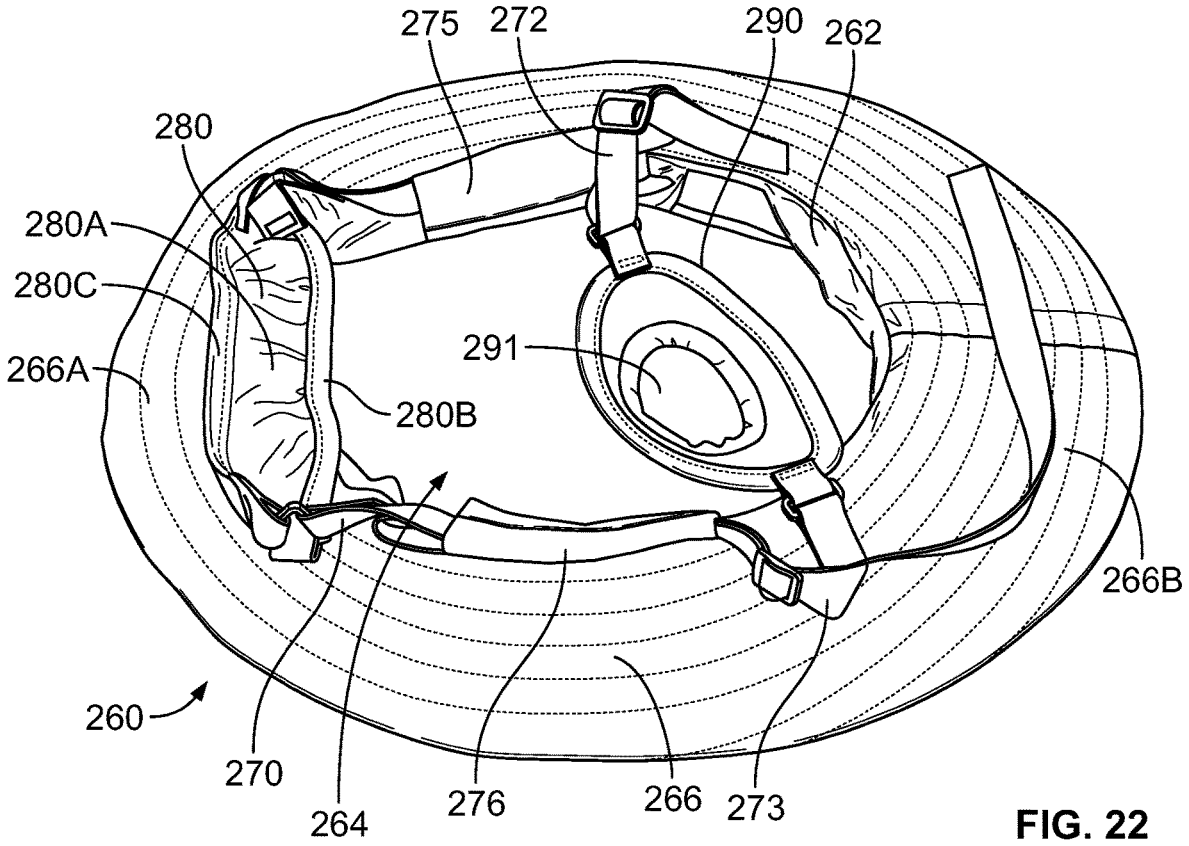
FIG. 22 is a bottom view of a brim apparatus according to another preferred embodiment of the invention.

FIG. 22 shows a bottom view of another preferred embodiment of the invention. As shown in FIG. 22, the apparatus 260 comprises a substantially oval flexible center section 262 defining an opening 204 sized to fit over a bicycle helmet, and a substantially oval visor 266 extending outwardly from the center section 262. The apparatus 260 can be made of cotton, or other suitable material such as nylon, polyester, cotton/polyester blends or water resistant material such as GORE-TEX or treated fabric. The visor 266 can be made of a stiff fabric interfacing, closed cell foam, lightweight plastic or other suitable material. The visor has a front portion 266A and a rear portion 266B.

The apparatus 260 in this embodiment uses a harness 270 to attach to the bicycle helmet. The harness consists of sliding straps 272, 273 fed through guides 275, 276 that are attached near the top of the center section 262. When the straps 272, 273 are tightened, a front cover, patch, or glove member 280 that has a longer center section 280A than upper 280B and lower 280C engages the front of the bicycle helmet and a rear cup 290 engages the rear of the bicycle helmet. The rear cup 290 has a center hole 291 and is shaped so as to fit the rear end of a tapered bicycle helmet.

In a preferred method of using the apparatus 260, the apparatus 260 is positioned over the bicycle helmet, with the front portion of the visor 266A above the front of the helmet, and the rear portion 266B of the visor 266 above the rear of the helmet. The apparatus 260 is pulled over the helmet, with the helmet going through the opening 264 of the center section 262. The harness 270 engages with the bicycle helmet by positioning the front cover 280 at the front of the bicycle helmet and the rear cup 290 at the rear of the bicycle helmet and then tightening the sliding straps 272, 273.

Figure 23:
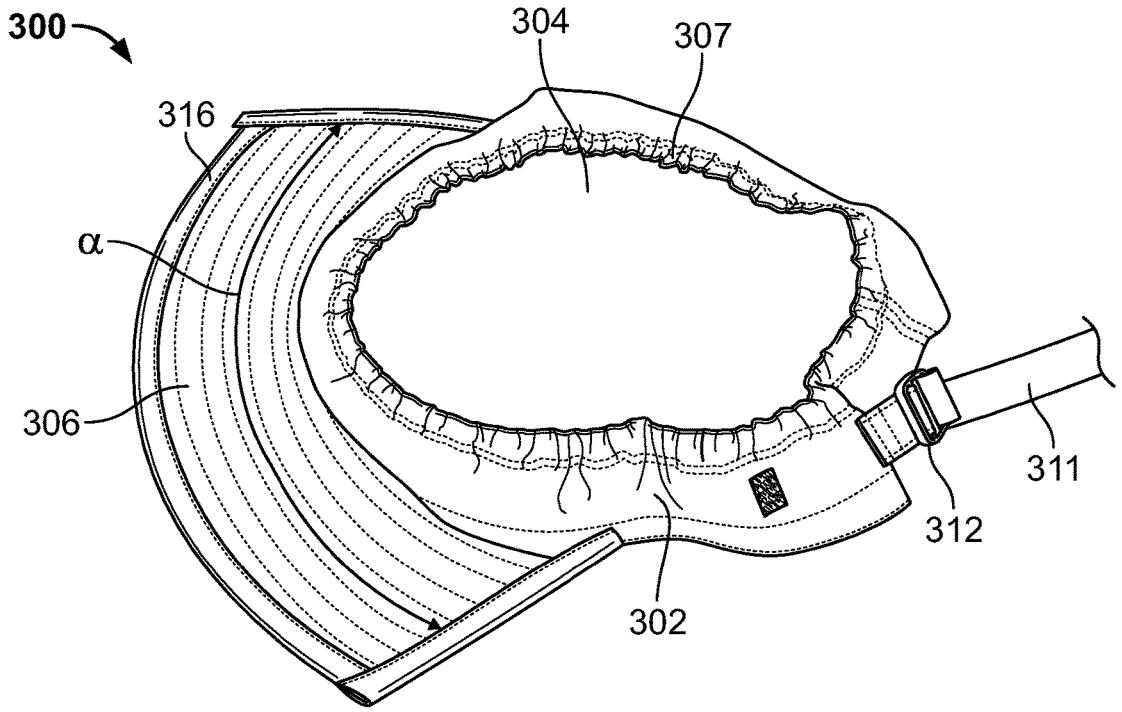
FIG. 23 is a top view of a partial brim apparatus according to another preferred embodiment of the invention.
Figure 24:
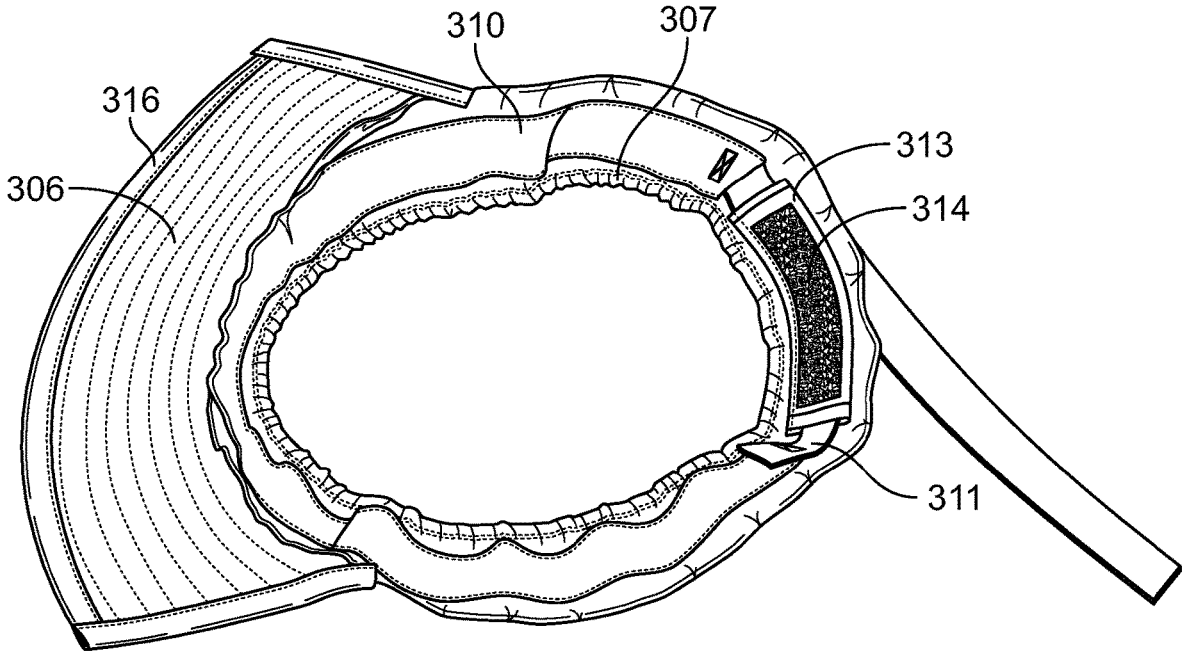
FIG. 24 is a bottom view of a the partial brim apparatus of FIG. 23.
Figure 25:
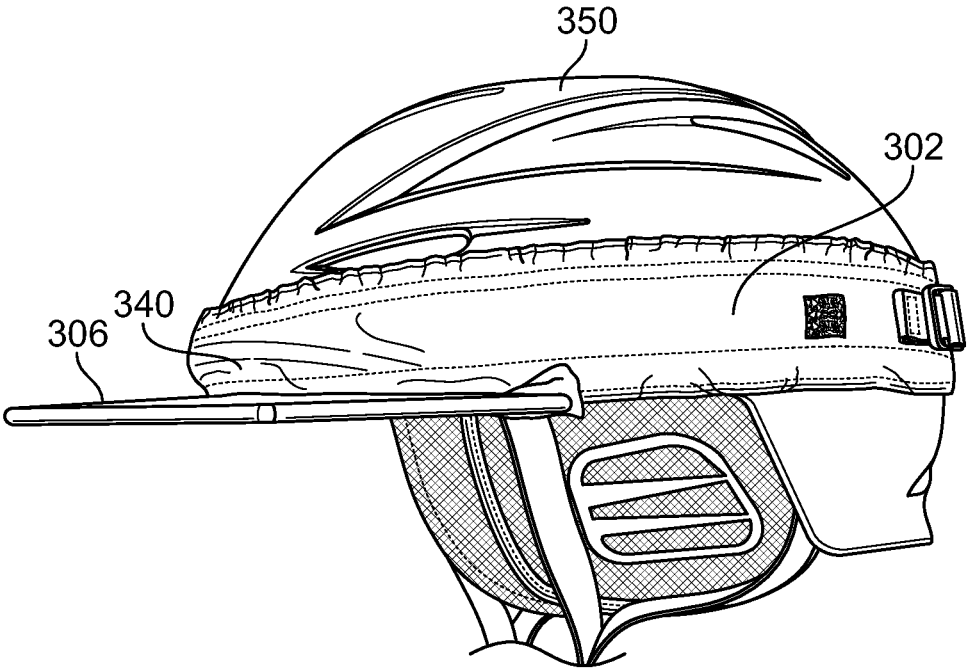
FIG. 25 is a perspective environmental view of the partial brim apparatus of FIG. 23.
Figure 26:
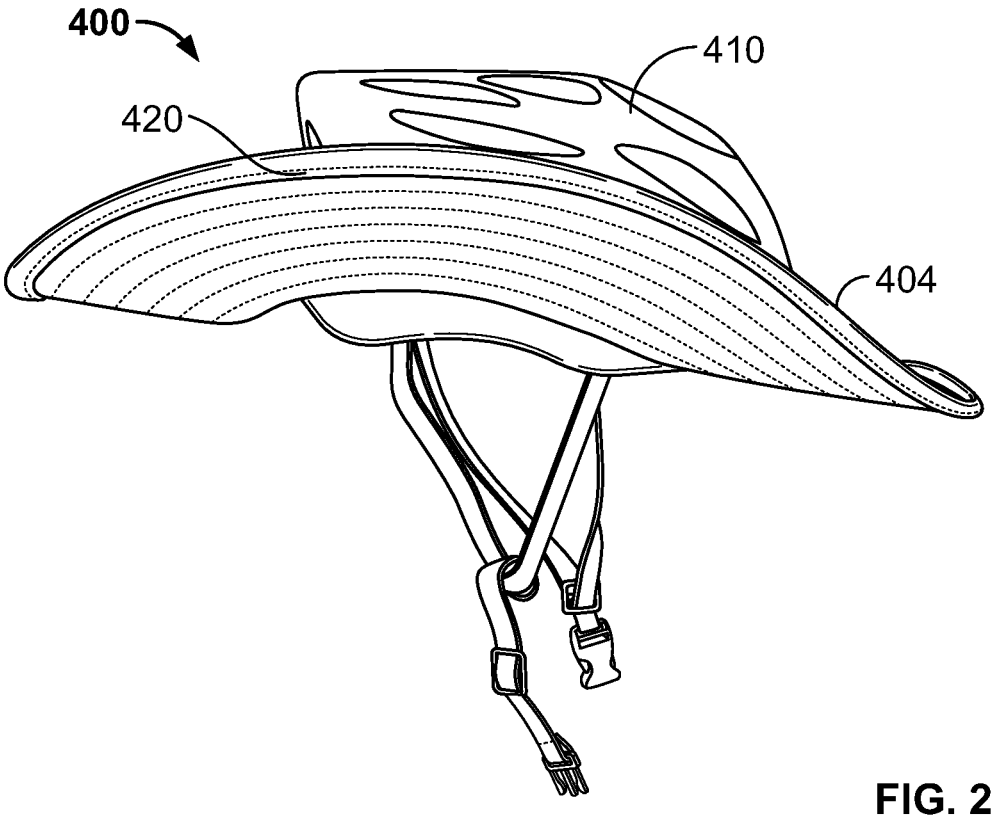
FIG. 26 is a side view of a brim apparatus according to another preferred embodiment of the invention engaged to a bike helmet.

A brim apparatus according to another embodiment of the invention is illustrated in FIGS. 23-25, and shown generally at reference numeral 300. As shown in FIGS. 23 and 24, the apparatus 300 comprises a substantially oval flexible center section 302 defining an opening 304 sized to fit over a sports helmet 350, and a visor 306 radially or outwardly extending from the center section 302 about a portion of the circumference of the center section 302. The center section is depicted in FIGS. 23-25 as a generally contiguous piece of fabric, however the center section may take other forms and need not be contiguous. The center section may be comprised of any suitable material and combinations of multiple types of materials, such as a portion of fabric and a portion of a strap so as to define an opening through which headgear can fit. The visor span angle $\alpha$ in this embodiment is about −60 to 60 degrees or spans a total arc angle of about 120 degrees. However, the span angle $\alpha$ may vary greatly. An exemplary non limiting range for the total arc angle is from 60 to 180 degrees, and more preferably from 90 to 150 degrees.

The apparatus 300 can be made of cotton, or other suitable material such as nylon, polyester, cotton/polyester blends or water resistant material such as GORE-TEX or treated fabric. The visor 306 can be made of a stiff fabric interfacing, closed cell foam, lightweight plastic or other suitable material.

The center section 302 preferably has an elastic portion 307 and has a section of anti-slip material 310 attached to the center section 302 for facilitating frictional engagement with helmet 350. The center section 302 can include means for adjusting the diameter of the opening 304 to accommodate helmets of varying size. As shown in FIGS. 23 and 24, the size adjustment feature can comprise a strap 311 and ladder lock buckle 312 attached to the center section 302. The strap 311 slides through a guide tube 313 that is attached near the top of the rear center section 302. The guide tube 313 has a piece of anti-slip material 314 attached to it. As such, the diameter of the center section opening 304 can be adjusted by the user by varying the length of the strap 311 at the ladder lock buckle 312. One skilled in the art can appreciate that other means than a ladder lock buckle 312, such as a complementary engaging sliding buckle, hook and loop fastener strap, ring with an associated strap with hooks or buckles, or other suitable material, can be used for adjustment of strap length.

As shown in FIGS. 23 and 24, a stiffening member, such as a plastic rod, is positioned at the outer edge of the visor 316 to help retain the shape of the visor 306. The stiffening member may extend into the center section 302 to maintain rigidity and prevent flopping. Alternatively, the stiffening member can be a square or flat wire or plastic rod or other suitable material.

FIG. 25 shows a brim apparatus according to one embodiment of the invention positioned over the sports helmet 350, with the front portion of the visor 306 above the front of the helmet 350, and the rear portion of the center section 302 above the rear of the helmet 350. The apparatus 300 is pulled over the helmet 350, with the helmet 350 going through the opening 304 of the center section 302 and engaging the anti-slip section 310 and pro-friction 314 material. When the apparatus 300 is affixed to the sports helmet, the center section 302 is adapted to form a stop surface 340, wherein the stop surface 340 prohibits the visor 306 from upward rotation. The stop surface also acts to clamp the apparatus 300 to the helmet 350 and prevents it from upward or downward rotation and from coming off the helmet. The center section also may form a shelf on which a portion of the underside of the helmet may sit. The other side of the stop surface on the center section contacts a portion of the underside of the helmet when the apparatus is affixed to the helmet.

A brim apparatus according to another embodiment of the invention is illustrated in FIGS. 26-29, and shown generally at reference numeral 400. The apparatus includes a visor 404 radially extending from a center section 406. Unlike the previous embodiments, however, the visor has a different shape. The visor 404 shown in FIGS. 26-29 has a cowboy hat shape. Lateral portions 420 are manipulated to curve upwards using straps 430. The degree of curvature may be adjusted by adjusting the straps 430. Adjusting the curvature of the visor improves aerodynamic performance.

Although straps 430 are shown in FIGS. 26-29 to hold lateral regions in an upward curved orientation, other means may be used to hold or adjust the curvature of the various regions of the visor. Examples include Velcro straps, snaps, eyelets, wire and plastic loops, etc. Additionally, the visor may include a preformed curvature or spring loaded orientation which biases the visor in a particular orientation and curvature. Shaped foams, internal ribs, and molded plastics or other materials may be incorporated into the visor to hold a desired shape.

Figure 27:
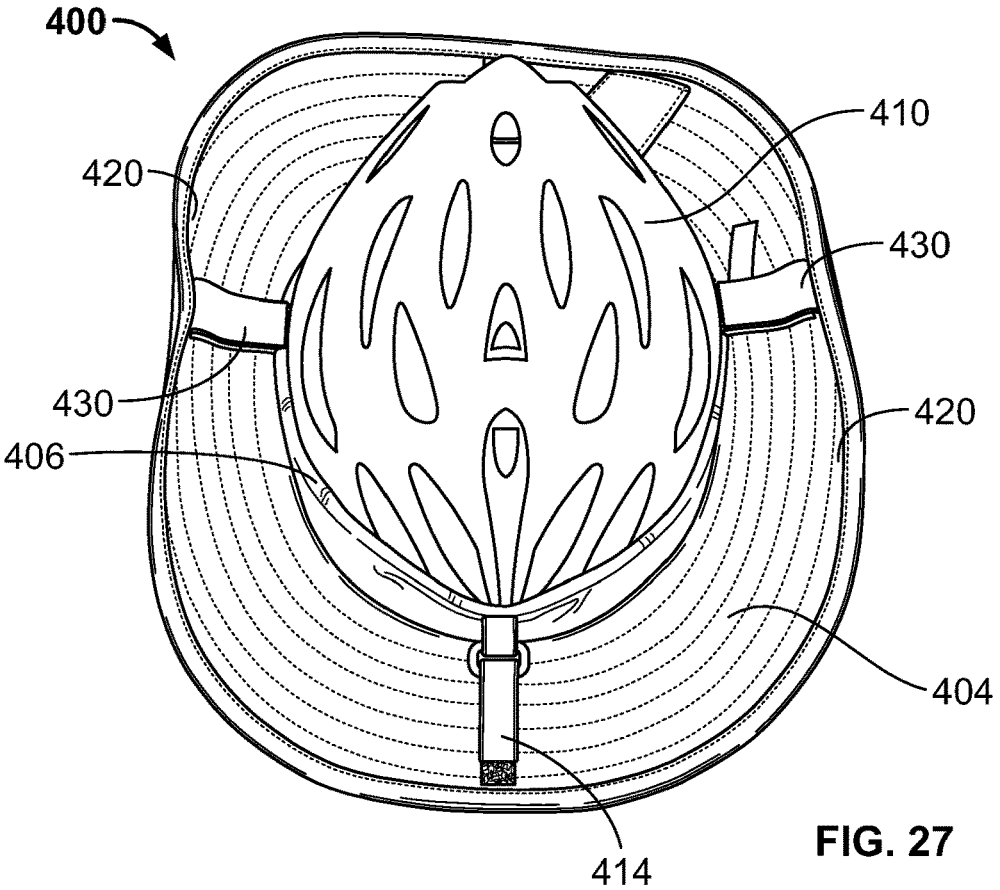
FIG. 27 is a top view of the brim apparatus of FIG. 26.
Figure 28:
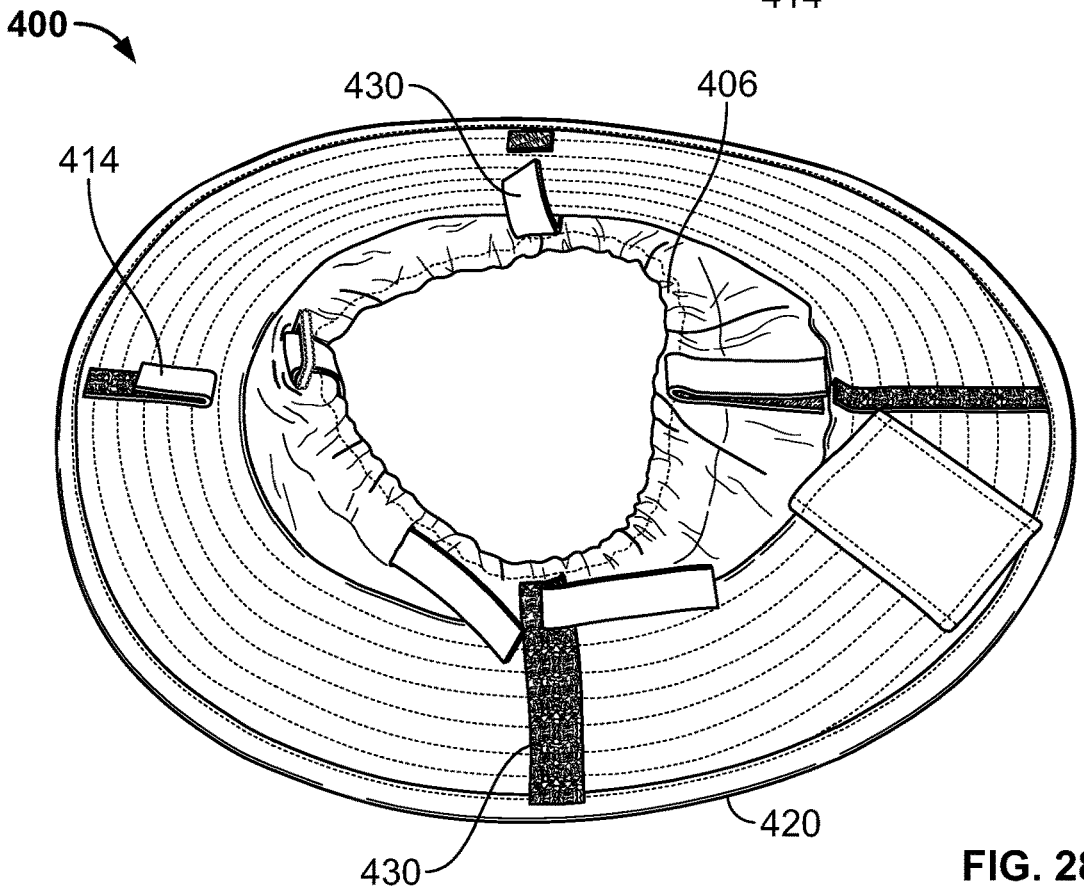
FIG. 28 is a top view of the brim apparatus of FIG. 26 shown in an undeployed configuration.
Figure 29:
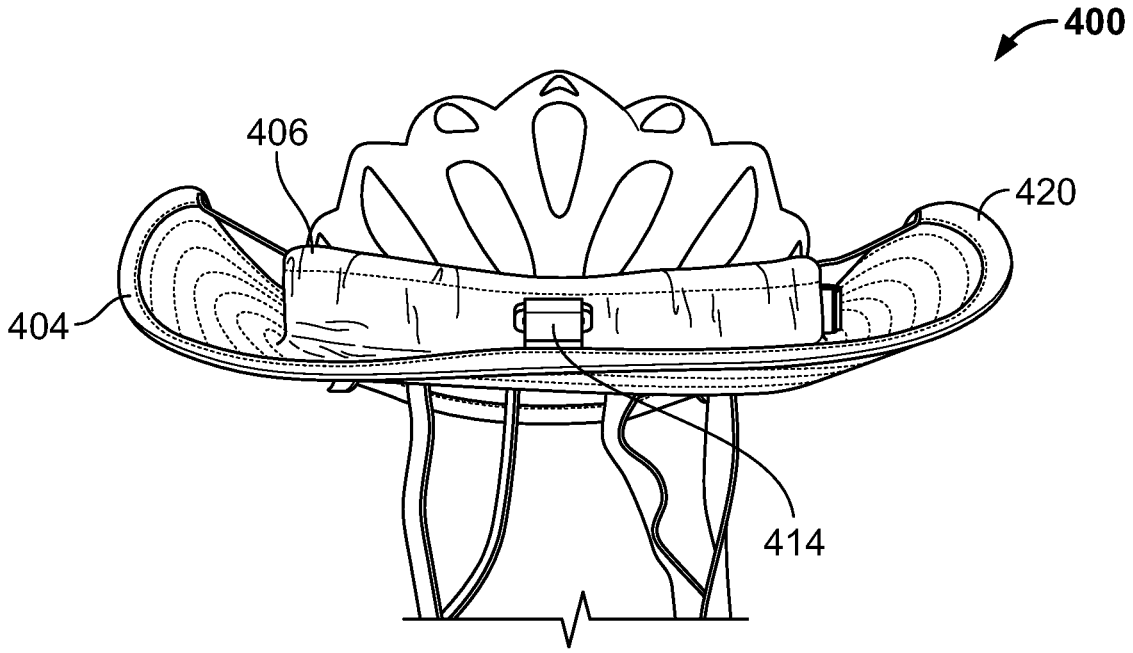
FIG. 29 is a front view of the brim apparatus of FIG. 26.

The apparatus 400 is also shown having a visor tilt angle adjustment feature 414 to adjust the angle at which the front portion of the visor 404 extends from the center section 406. As shown in FIG. 27, the adjustment feature can consist of a hook and loop fastener strap passed through a ring that is attached near the top of the front center section. A sliding strap or other suitable means may be used. The tilt angle may vary and may range as described above in connection with the other brim embodiments incorporating a tilt angle adjustment feature.

Figure 30:
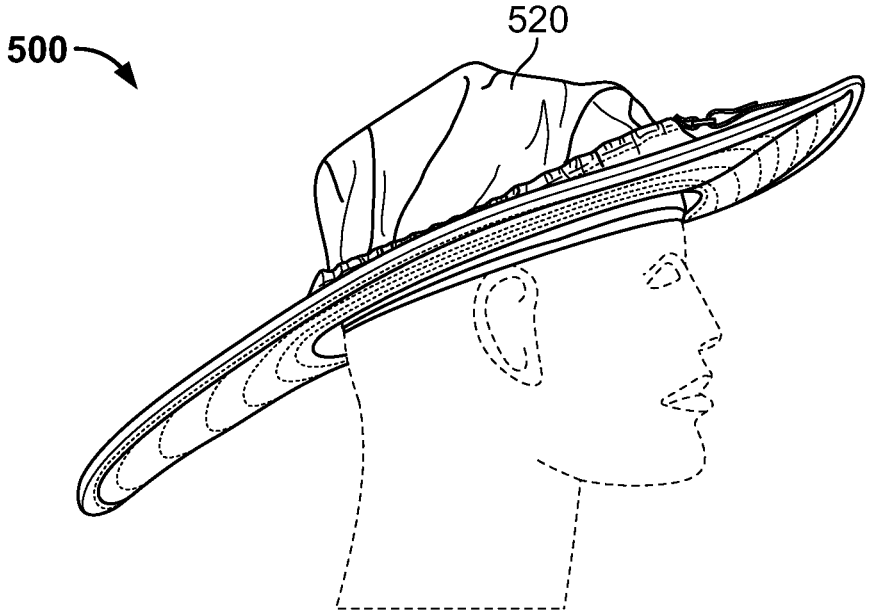
FIG. 30 is a side view of a brim apparatus including a crown member according to another preferred embodiment of the invention.
Figure 31:
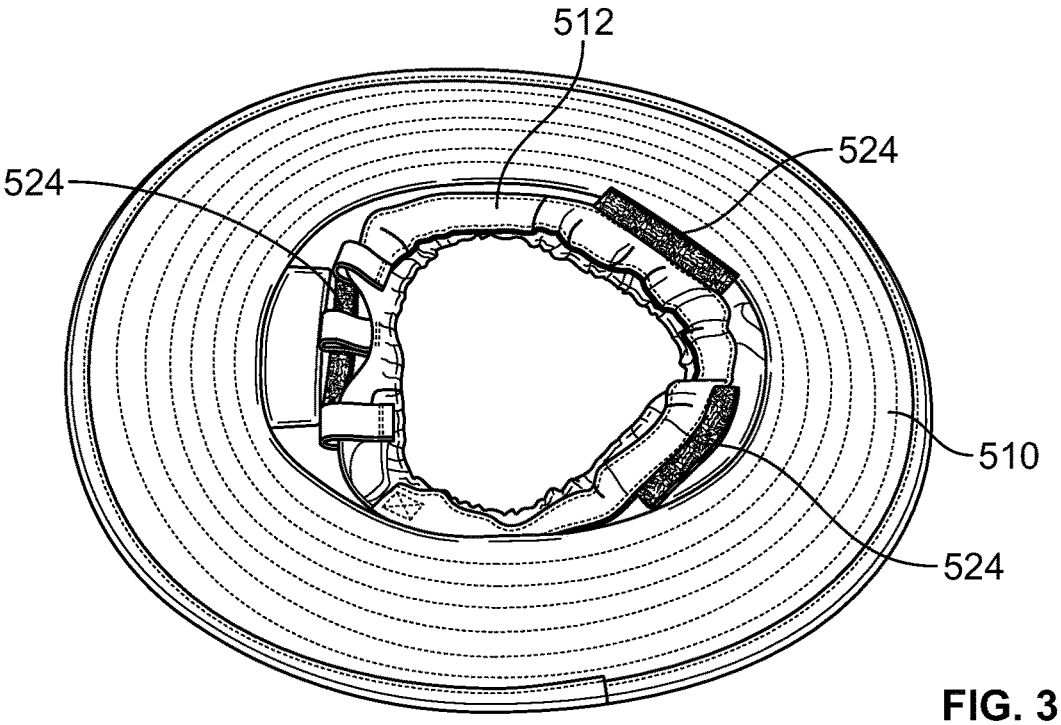
FIG. 31 is a bottom view of the brim apparatus of FIG. 30 shown without the crown member.
Figure 32:
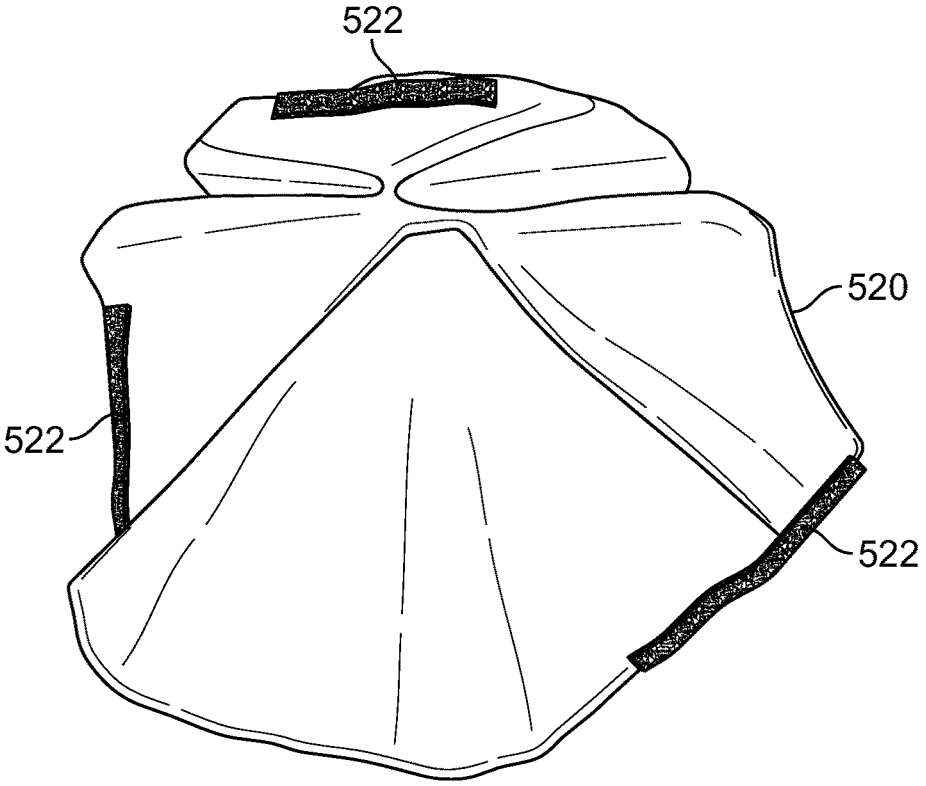
FIG. 32 is a top view of the crown member of FIG. 30 shown in an undeployed configuration.

A brim apparatus according to another embodiment of the invention is illustrated in FIGS. 30-32, and shown generally at reference numeral 500. The apparatus 500 is similar to the brim apparatus described above except that it includes a detachable crown, cover or cap portion 520. The crown 520 is shown engaged to the center section 512 via three hook 524 and loop 522 fasteners on the center section and crown respectively. However, a wide range of fasteners and materials including but not limited to zippers, snaps, and so forth may be used to engage crown with the visor. Velcro may be used to attach the cover to the center section or visor. One or more strips of Velcro may be placed around the center section. The fastener means may be contiguous or include discrete elements.

Figure 33:
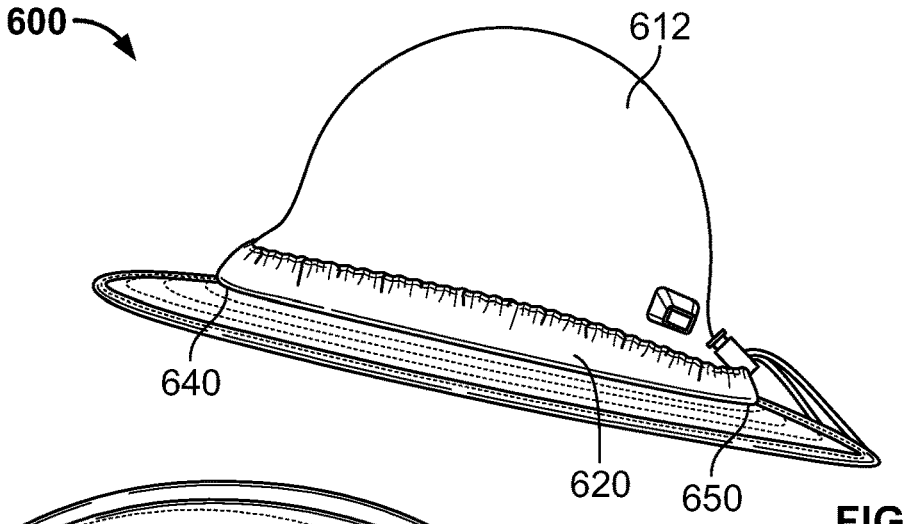
FIG. 33 is a side view of a brim apparatus secured to a hard hat according to another preferred embodiment of the invention.
Figure 34:
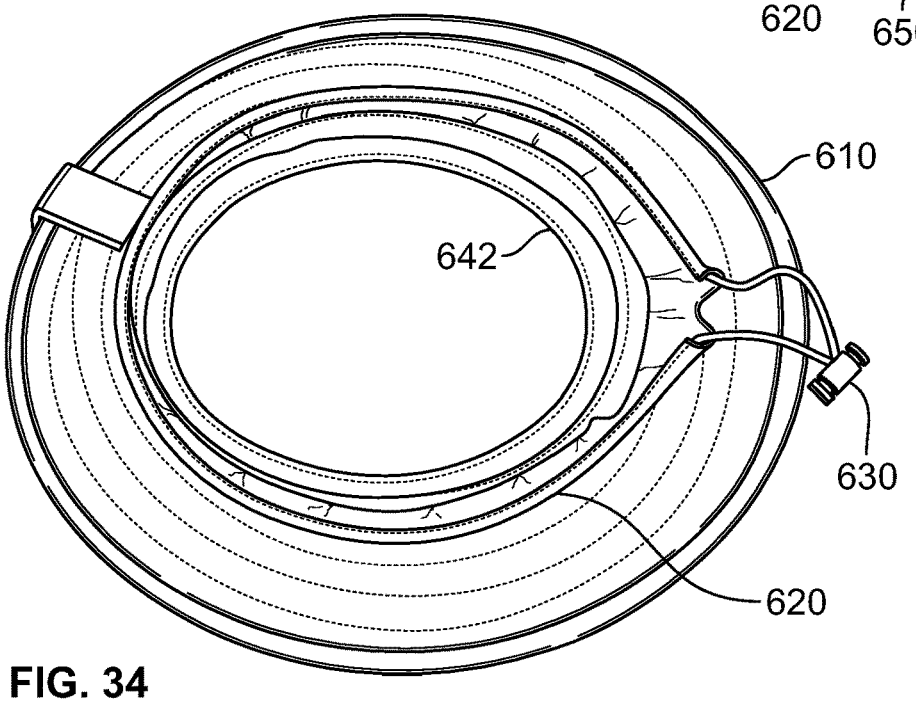
FIG. 34 is a top view of the brim apparatus of FIG. 33.
Figure 35:
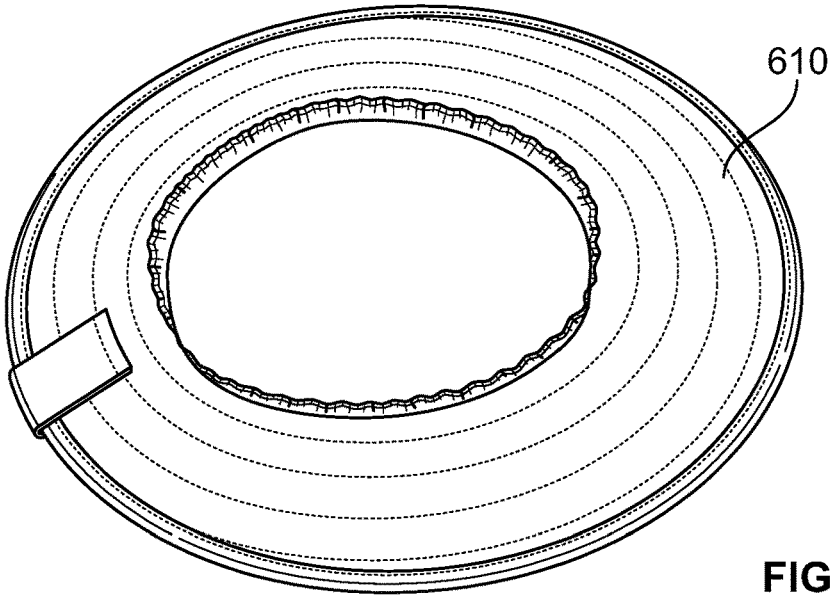
FIG. 35 is a bottom view of the brim apparatus of FIG. 33.

A brim apparatus according to another embodiment of the invention is illustrated in FIGS. 33-35, and shown generally at reference numeral 600. The apparatus 600 includes a visor 610 radially extending from a center section 620.

Similar to the embodiments described herein, the diameter of the center section and brim may be adjusted to engage the circumference of the hardhat. In the apparatus shown in FIGS. 33-35, the diameter of the center section may be adjusted using a rope which extends through a channel in the center section. The rope may be tightened as desired and locked via cord lock 630. However, the invention is not intended to be so limited. Other techniques and means may be incorporated to snugly secure the brim apparatus to the hard hat or helmet.

Additionally, in an alternative embodiment, the diameter of the center section is non-adjustable. The opening of the center section is pre-fit for a particular size or size range of headgear. Additionally, in embodiments, the center section may comprise a resilient or elastic portion such that the diameter of the opening may conform to the outer circumference of the headgear. The opening may be designed to be slightly undersized relative to the headgear such that when the headgear is placed within the opening of the brim apparatus, a snug fit is obtained. Additionally, combinations of the above may be incorporated into the brim apparatus. For example, an adjustable and elastic center section may be provided to suitably fit a headgear.

FIG. 33 also shows a clamp or stop surface 640 when the brim apparatus 600 is secured to the hard hat 612. The stop surface serves to snugly secure the short pre-integrated bill on hard hats. The pre-integrated bill of the hard hat rests on top of the inner lip 642 of the visor 610, creating a stop surface at the inner lip of the visor 642. Additionally, in some embodiments, the bill does not directly contact the visor or inner lip of the visor, and rests on the center section 620 itself. For example, this can happen if the outer circumference of the hard hat is smaller than the length of the center section where it is attached to the brim. The center section is tightened over the bill and to the exterior of the hard hat, thereby clamping or holding the pre-integrated bill of the hard hat in a circumferential pocket formed between the visor 640 and the tightened center section 620, or deform center section 620 around the bill. This serves to securely clamp or hold the brim apparatus 600 to the hard hat 612.

Although the stop surface is shown positioned towards the front of the headgear, the stop surface may be formed at other locations including lateral positions, rearward locations, and other locations along the circumference of the headgear. The stop or clamping surface serves to prevent upward rotation of the visor and to snugly hold the center section of the brim apparatus to various helmets, hardhats and other headgear. The center section may form a shelf on which a portion of the underside of the helmet may sit. The other side of the stop surface on the center section contacts a portion of the underside of the helmet when the apparatus is affixed to the helmet.

Additionally, although a rope and cord lock 630 is shown to secure the center section to the hard hat (and to form the stop surface), other mechanisms may be incorporated into the brim apparatus to secure the center section to the hard hat and to form the stop surface. The invention is intended only to be limited as recited in the appended claims. All the features of the preferred embodiments described above are interchangeable on the various embodiments except where such modification would render the invention inoperable. Also, it should be noted that while the preferred embodiments disclosed above are described as being used with bicycle, skateboard, snow sport, paddling, mountain/rock climbing and equestrian helmets, the invention is not so limited, and can be used in conjunction with a variety of headgear, including hard hats used in construction, dock loading, and airport baggage handling.

It should also be noted that any of the preferred embodiments may be packaged with a sports helmet to form a sports helmet system. In one embodiment a system includes a sports helmet such as, e.g., a bike helmet model Venture, manufactured by Easton Bell Sports, Inc. (Van Nuys, California, USA), and a brim as described herein. A system for snowboarding may include a helmet, brim, and goggles. Helmet systems may also include covers, nets, and or clips.

A brim apparatus for use on headgear and a method of using same are described above. Various changes can be made to the invention without departing from its scope. The above description of the preferred embodiments and best mode of the invention are provided for the purpose of illustration only and not limitation.

The invention claimed is:

1. A brim apparatus adapted to be attached to a helmet, the helmet comprising a pre-integrated bill, the apparatus comprising:

a visor comprising a front portion, a rear portion, and an opening to receive the helmet, the opening comprising a first circumference;

a center section comprising a ring-shape including a bottom, a top, a front portion, sides, and a rear portion, wherein the bottom of the center section is joined to the visor along the first circumference; and a flap secured to an underside of the front portion of the visor, and wherein the flap and the underside of the front portion of the visor are arranged to receive and enclose at least a portion of the pre-integrated bill of the helmet, and wherein the flap and underside of the front portion of the visor cooperate together to clamp around the periphery of the pre-integrated bill and prevent the brim apparatus from coming off the helmet; and wherein the flap and underside of the front portion of the visor comprise a suitable fastening-type device to clamp around the periphery of the pre-integrated bill.

2. The apparatus of claim 1 further comprising a size adjustment member extending through the center section, and wherein the size adjustment member is tightenable to adjust the diameter of the center section to detachably fit about the helmet.

3. The apparatus of claim 2 wherein the size adjustment member is a strap.

4. The apparatus of claim 3 wherein the center section further comprises a buckle member to vary the length of the strap.

5. The apparatus of claim 2, further comprising at least one guide located in the rear portion of the center section and closer to the top of the center section than the bottom, and wherein the size adjustment member passes through the guide.

6. The apparatus of claim 5 wherein the at least one guide comprises a plurality of loops.

7. The apparatus of claim 1 wherein the first circumference has a substantially fixed size.

8. The apparatus of claim 7 wherein the center section further comprises a top circumference, and the top circumference has an elasticity such that the top circumference may vary in diameter and shape as the apparatus is tightened about the helmet.

9. The apparatus of claim 1 wherein the visor comprises a stiffening member.

10. The apparatus of claim 1 wherein an interior surface of the center section comprises anti-slip material.

11. The apparatus of claim 1 wherein the visor radially extends from the center section about a portion of an outer perimeter of the bottom of the center section.

12. The apparatus of claim 1 wherein the visor radially extends from the center section in 360 degrees.

13. The apparatus of claim 1 wherein the rear portion is greater in length than the front portion.

14. The apparatus of claim 1 wherein the flap is secured to the underside of the visor by hook and loop fasteners.

15. The apparatus of claim 14, wherein the hook and look fasteners comprise multiple discrete areas of hook and loop fasteners, arranged in spaced-apart elongate strips.

16. The apparatus of claim 1 wherein flap has a semi-circular, arcuate or moon shape.

17. A brim apparatus adapted to be attached to a helmet, the helmet comprising a pre-integrated bill, the apparatus comprising:

a visor comprising a front portion, a rear portion, and an opening to receive the helmet, the opening comprising a first circumference;

a center section comprising a ring-shape including a bottom, a top, a front portion, sides, and a rear portion, wherein the bottom of the center section is joined to the visor along the first circumference; and a plurality of discrete regions of hook and loop fasteners arranged on an underside surface of the front portion of the visor; and a reinforcing member attached to the underside surface of the visor by the hook and loop fasteners, and wherein the plurality of discrete regions on the underside surface of the front portion of the visor and the reinforcing member cooperate together to fasten around an edge of the bill, thereby clamping the bill between opposing surfaces of the reinforcing member and the underside surface of the front portion of the visor.

18. The apparatus of claim 17 wherein the reinforcing member has a semi-circular, arcuate or moon shape.

19. The apparatus of claim 17, wherein the plurality of discrete regions of hook and loop fasteners are arranged in spaced-apart elongate strips, extending in a radial direction from the center section.

* * * * *